US010813837B2

(12) United States Patent
Mosler et al.

(10) Patent No.: US 10,813,837 B2
(45) Date of Patent: Oct. 27, 2020

(54) PRE-FILLED DILUENT SYRINGE VIAL ADAPTER

(71) Applicant: Yukon Medical, LLC, Durham, NC (US)

(72) Inventors: Theodore J. Mosler, Durham, NC (US); David L. Foshee, Durham, NC (US); Todd Korogi, Durham, NC (US)

(73) Assignee: Yukon Medical, LLC, Durham, NC (US)

( * ) Notice: Subject to any disclaimer, the term of this patent is extended or adjusted under 35 U.S.C. 154(b) by 535 days.

(21) Appl. No.: 15/123,399

(22) PCT Filed: Mar. 5, 2015

(86) PCT No.: PCT/US2015/019012
§ 371 (c)(1),
(2) Date: Sep. 2, 2016

(87) PCT Pub. No.: WO2015/134777
PCT Pub. Date: Sep. 11, 2015

(65) Prior Publication Data

US 2017/0065486 A1 Mar. 9, 2017

Related U.S. Application Data

(60) Provisional application No. 62/071,040, filed on Sep. 12, 2014, provisional application No. 61/966,872, filed on Mar. 5, 2014.

(51) Int. Cl.
*A61J 1/20* (2006.01)

(52) U.S. Cl.
CPC ..... *A61J 1/2096* (2013.01); *A61J 1/201* (2015.05); *A61J 1/2013* (2015.05); *A61J 1/2051* (2015.05); *A61J 1/2055* (2015.05); *A61J 1/2072* (2015.05)

(58) Field of Classification Search
CPC ..... A61J 1/20–2096
See application file for complete search history.

(56) References Cited

U.S. PATENT DOCUMENTS 4,759,756 A 7/1988 Forman et al.
5,385,547 A * 1/1995 Wong ..... A61J 1/2089 604/414

(Continued)

FOREIGN PATENT DOCUMENTS

DE 202013105808 U1 1/2014
EP 2455058 A1 5/2012

(Continued)

OTHER PUBLICATIONS

Korean Intellectual Property Office; International Search Report and Written Opinion for International Application No. PCT/US2015/019012 dated Jun. 22, 2015, 13 Pages.

(Continued)

*Primary Examiner* — Benjamin J Klein
(74) *Attorney, Agent, or Firm* — Christopher J. Knors; Moore & Van Allen PLLC

(57) ABSTRACT

In some embodiments, an adapter comprises an adapter body comprising a coupling member configured for coupling with a pre-fillable assembly and a spike having at least one conduit extending from a central body. At least one conduit extends through the spike, adapter body and the coupling member. A spike cover is sized to receive and seal the spike, the cover reversibly securable to the central body and receiving members configured to receive a vial shroud.

2 Claims, 29 Drawing Sheets

(56) References Cited

U.S. PATENT DOCUMENTS

| | | | | |
|---|---|---|---|---|
| 5,833,674 | A | 11/1998 | Turnbull et al. | |
| 6,645,171 | B1 | 11/2003 | Robinson et al. | |
| 8,608,723 | B2 | 12/2013 | Lev et al. | |
| 2002/0068896 | A1 | 6/2002 | Robinson et al. | |
| 2002/0193777 | A1 | 12/2002 | Aneas | |
| 2008/0138376 | A1 | 6/2008 | Harman et al. | |
| 2008/0249479 | A1 | 10/2008 | Zinger et al. | |
| 2010/0260007 | A1 | 10/2010 | Harman et al. | |
| 2011/0264069 | A1 | 10/2011 | Bochenko | |
| 2012/0123382 | A1 | 5/2012 | Kubo | |
| 2014/0311624 | A1* | 10/2014 | Eilertsen ..... | A61J 1/2096 141/18 |
| 2014/0361045 | A1 | 12/2014 | Harman et al. | |
| 2015/0209230 | A1 | 7/2015 | Lev et al. | |
| 2017/0312175 | A1 | 11/2017 | Lev et al. | |

FOREIGN PATENT DOCUMENTS

| | | | |
|---|---|---|---|
| GB | 1419061 | A | 12/1975 |
| WO | 97/46203 | A1 | 12/1997 |
| WO | 2006120461 | A1 | 11/2006 |
| WO | 2011004360 | A1 | 1/2011 |
| WO | 2014033706 | A2 | 3/2014 |

OTHER PUBLICATIONS

European Patent Office; Partial Supplementary European Search Report for European Patent Application No. 15759097.7 dated Oct. 5, 2017, 14 Pages.

European Patent Office; Intention to Grant for European Patent Application No. 15759097.7 dated Oct. 15, 2018, 5 Pages.

International Bureau of WIPO; International Preliminary Report on Patentability for International Application No. PCT/US2015/019012 dated Sep. 15, 2016, 12 Pages.

European Patent Office; Supplemental Extended European Search Report for European Patent Application No. 15759097.7 dated Feb. 1, 2018, 15 Pages.

European Patent Office; Extended European Search Report for European Patent Application No. 19170397.4 dated Nov. 12, 2019, 7 Pages.

* cited by examiner

PRE-FILLED DILUENT SYRINGE VIAL ADAPTER

CROSS-REFERENCE TO RELATED APPLICATIONS

This application is a 35 U.S.C. § 371 National Stage Application of International Application No. PCT/US2015/019012, filed Mar. 5, 2015, which claims the benefit of U.S. Provisional Application No. 62/071,040 filed on Sep. 12, 2014, and U.S. Provisional Application No. 61/966,872 filed on Mar. 5, 2014, the entirety of each of which is incorporated herein by reference.

BACKGROUND

In order to increase the length of viability in storage for certain drugs, methods have been developed for freeze-drying or lyophilization of these compounds. These processes result in a dry powder cake sealed in a glass vial of appropriate size with a standard finish, or means of sealing. These means of sealing typically consist of a butyl rubber stopper crimped to the top rim of the glass vial with an aluminum cap. The most common of the standard sizes are 13 mm, 20 mm, and 28 mm, referring to the diameter of the crimped tops. In order to utilize these drugs, they must be reconstituted with an appropriate diluent and transferred from the vial to a syringe for injection. Traditionally a syringe was fitted with a needle which was used to pierce a vial containing the specified diluent and the correct volume of diluent was withdrawn. The syringe and needle was then used to pierce the butyl rubber stopper of the lyophilized drug vial, the diluent injected, and the drug reconstituted, usually by gently swirling the vial until the drug was completely dissolved. The syringe needle was then reinserted through the stopper and the reconstituted drug withdrawn by inverting the vial and pulling back on the plunger of the syringe. Additionally the vial becomes pressurized when the diluent is added with no means of venting out air to balance the change in volume, which can make fine control with the syringe difficult. Care had to be taken to position the needle tip such that the majority of the liquid drug was removed. With the reconstituted drug now in the syringe, the needle that had been used for transferring the diluent and drug, typically a larger diameter needle for ease of flow and now dulled by multiple piercings of the rubber stopper, would be removed and replaced with a needle for injection.

Risks inherent to this procedure include the possibility of needle-stick during the prolonged handling of multiple needles, potential for user error in the measuring of diluent and withdrawal of reconstituted drug, use of wrong needle for transfer or injection, and the potential contamination of the drug with particulate created by the steel needle penetrating the soft rubber seal. The present disclosure employing an adapter as described simplifies the process of reconstitution and reduces the user's exposure to needle handling.

SUMMARY

In some embodiments, an adapter comprises an adapter body comprising a coupling member configured for coupling with a pre-fillable assembly and a spike having at least one conduit extending from a central body. At least one conduit extends through the spike, adapter body and the coupling member. A spike cover is sized to receive and seal the spike, the cover reversibly securable to the central body and receiving members configured to receive a vial shroud.

In another aspect of the embodiment, the at least one conduit includes a vent conduit. In another aspect, alone or in combination with any of the previous aspects, the adapter body is configured with generally cylindrical side walls. In another aspect, alone or in combination with any of the previous aspects, the adapter body is configured with generally cylindrical side walls extending longitudinally from the central body. In another aspect, alone or in combination with any of the previous aspects, the coupling member is generally cylindrical and configured to be slidably received within the cylindrical side walls of the adapter body.

In some embodiments, alone or in combination with any of the previous aspects, the adapter body further comprises an elastomeric plug positioned within the coupling member, the elastomeric plug secured between the coupling member and the central body. In another aspect, alone or in combination with any of the previous aspects, the adapter body further includes a penetrating cannula having one end coupled to the central body, the penetrating cannula fluidically coupled to the at least one conduit, and a second end extending at least partially into the coupling member, the adapter configured in a first state wherein the second end of the penetrating cannula is sealed by the elastomeric plug.

In another aspect, alone or in combination with any of the previous aspects, the penetrating cannula is configured in the first state to be aseptically sealed within the adapter by the elastomeric plug and the spike cover. In another aspect, alone or in combination with any of the previous aspects, the adapter is configured in the first state to seal contents of the prefill syringe device and/or control contact of the contents of the prefill syringe to the penetrating cannula, elastomeric plug, and the spike cover.

In another aspect, alone or in combination with any of the previous aspects, the adapter is configured to transition to a second state wherein the second end of the penetrating cannula penetrates the elastomeric plug. In another aspect, alone or in combination with any of the previous aspects, the coupling member is configurable to slidably traverse within the adapter body to urge the penetrating cannula to penetrate the elastomeric plug and provide fluidic communication between the coupling member and the at least one conduit of the spike in the second state. In another aspect, alone or in combination with any of the previous aspects, the adapter is configurable to transition from the first state to the second state upon coupling of the coupling member with a pre-fillable device.

In another aspect, alone or in combination with any of the previous aspects, the coupling member is configured with locking features receivable by complementary locking features of the adapter body in the second state so as to prevent return to the first state.

In some embodiments, alone or in combination with any of the previous aspects, the adapter body further includes a valve having a cracking pressure, the valve configured to control fluid flow between the at least one conduit of the spike and the coupling member. The valve is configured in a first state wherein fluid flow through the at least one conduit of the spike is prevented. In another aspect, alone or in combination with any of the previous aspects, the adapter is configured in the first state to seal contents of the prefill syringe device and/or control contact of the contents of the prefill syringe to the valve.

In another aspect, alone or in combination with any of the previous aspects, the valve is configurable to transition to a second state upon exceeding the cracking pressure wherein the valve opens and allows fluid flow between the at least one conduit of the spike. In another aspect, alone or in combination with any of the previous aspects, the coupling member is configurable to welding with the central body to contain the valve. In another aspect, alone or in combination with any of the previous aspects, the coupling member is configurable to snap-fit coupling with the central body to contain the valve.

DETAILED DESCRIPTION

Pre-Filled Diluent Cartridge-Syringe Assemblies

Figure 1:
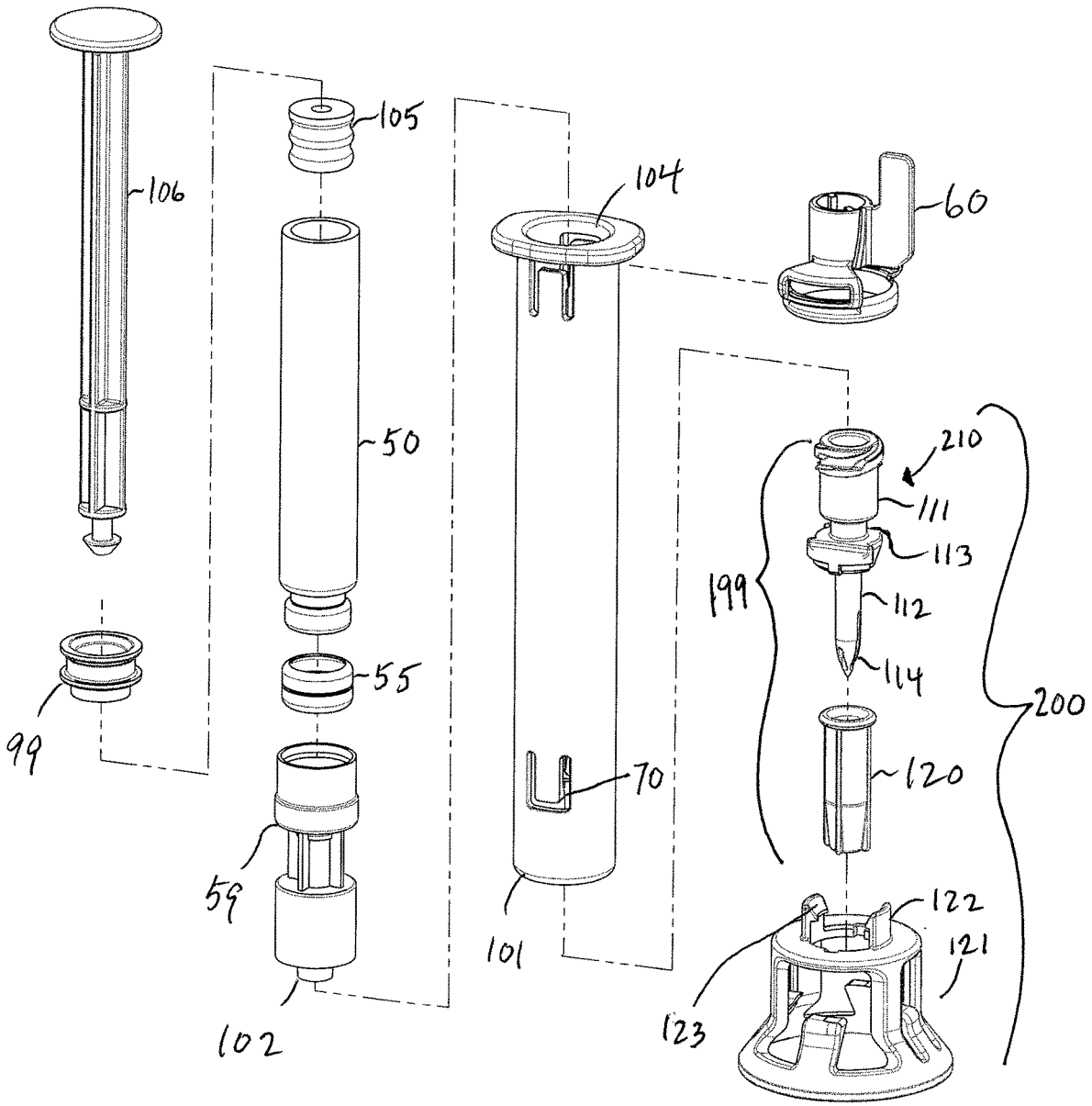
FIG. 1 is an exploded view of an adapter embodiment disclosed and described herein.
Figure 2A:
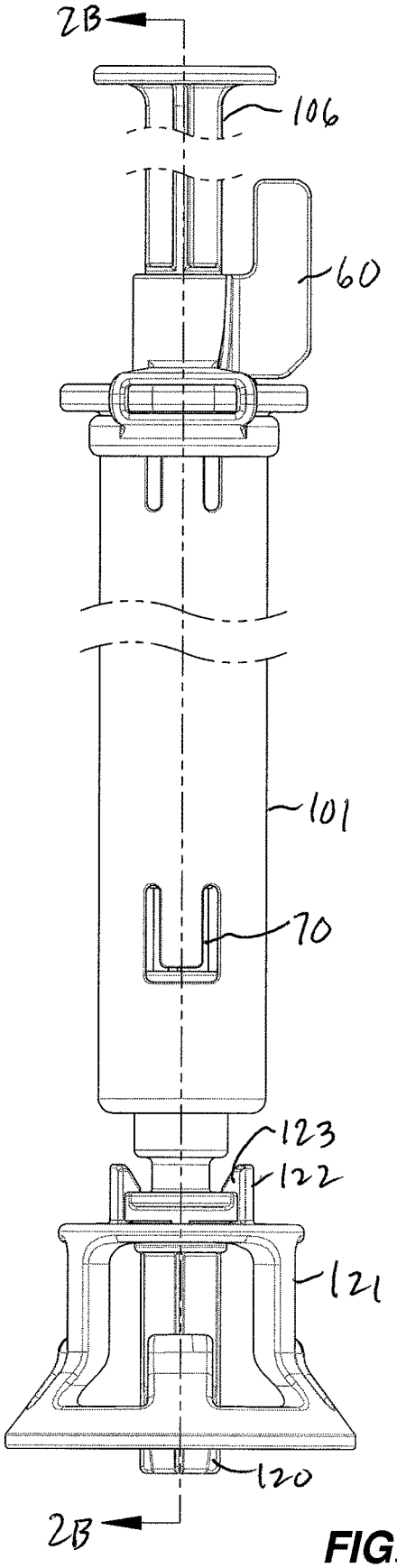
FIG. 2A is a perspective view section view of the adapter of FIG. 1 assemble to a prefilled cartridge-syringe device.
Figure 2B:
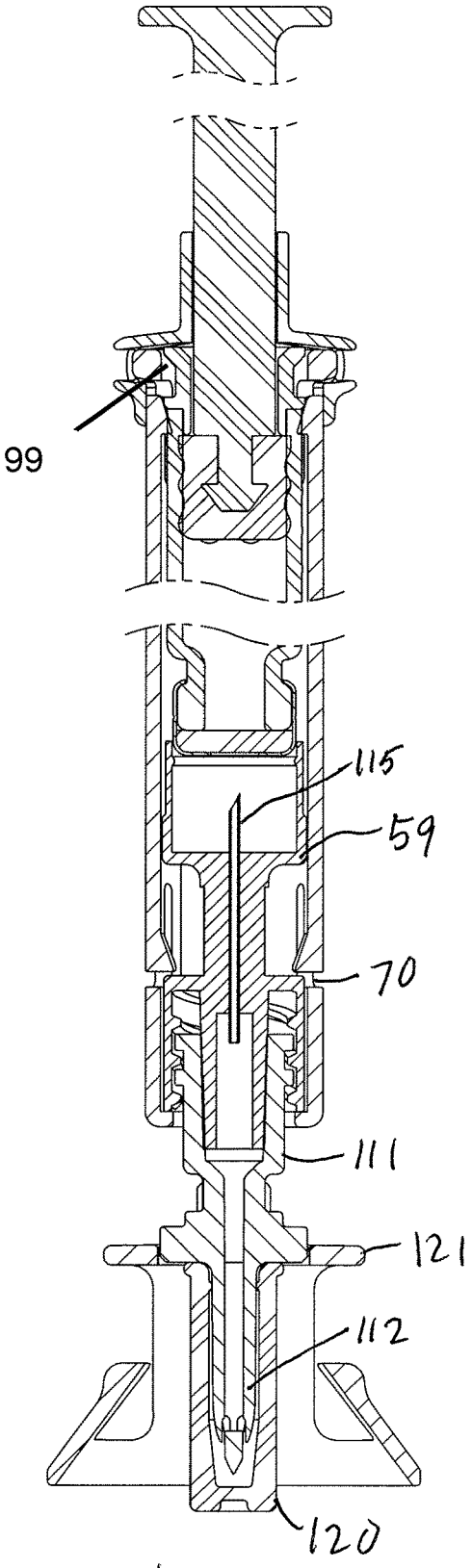
FIG. 2B is a sectional view along section line 2B-2B of the adapter of FIG. 1.
Figure 2C:
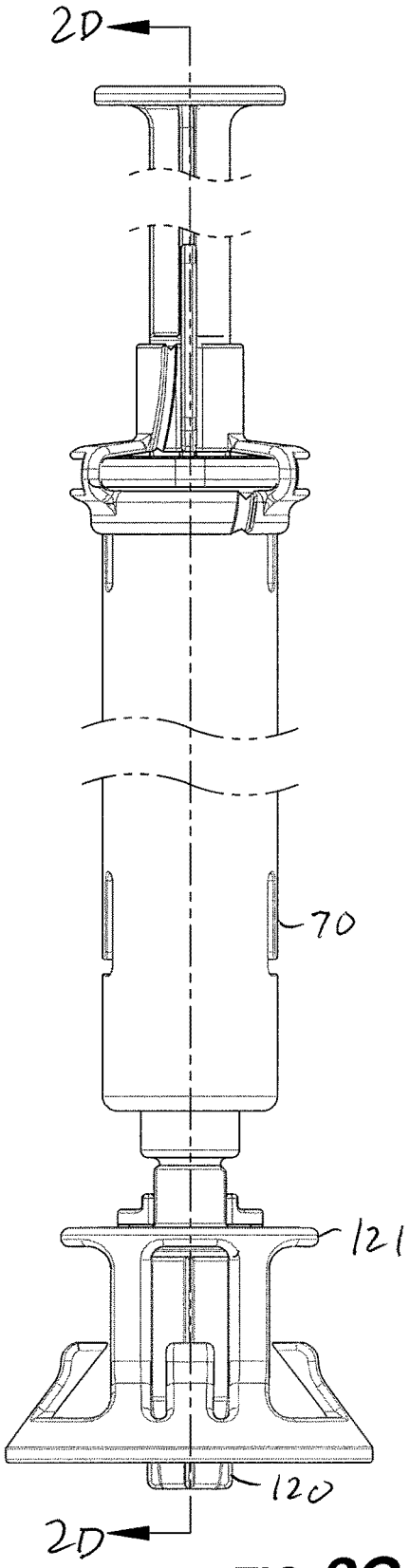
FIG. 2C is a perspective view section view of the adapter of FIG. 2A rotated 90°.
Figure 2D:
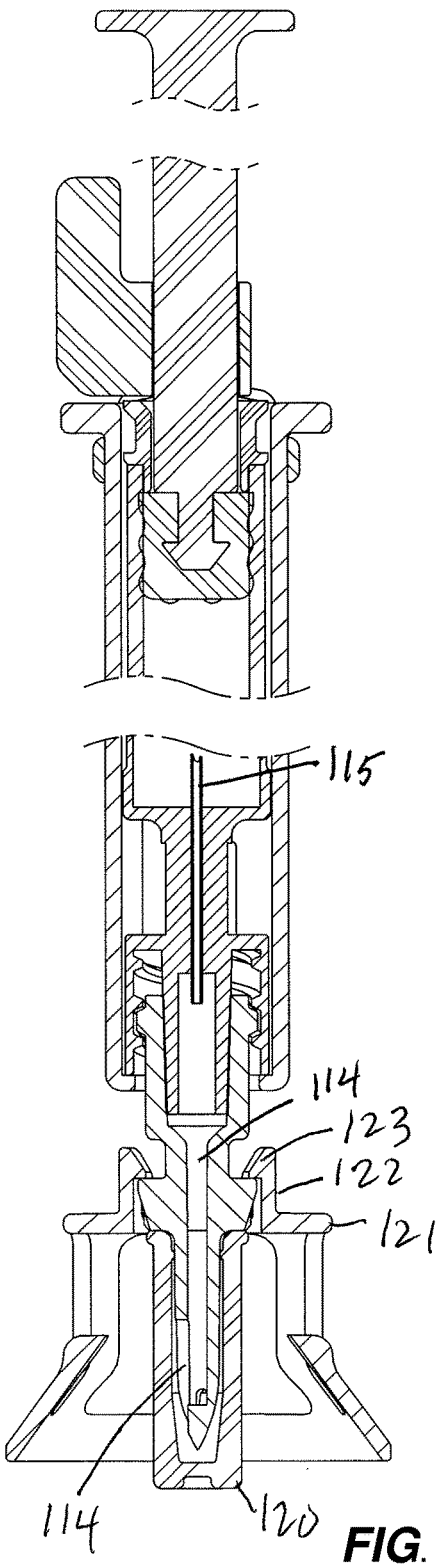
FIG. 2D is a sectional view along section line 2D-2D of the adapter of FIG. 1.

In some embodiments, an adapter is provided configured for a prefilled diluent cartridge housed in a syringe-like housing is provided. This configuration allows the user to interface with the adapter as if it were a simple syringe and reduces the number of containers in the reconstitution process. The cartridge is typically a glass container or autoclavable plastic with butyl rubber stoppers that can preserve the diluent in a sterile condition for long periods. A break-away tab at the plunger rod and housing juncture prevents unintentional activation of the cartridge. A vial access device is attached to the luer of the syringe barrel, with a spike cover over the plastic vial access spike to preserve sterility.

Pre-Filled Diluent Syringe Assemblies (No Cartridge)

In some embodiments, the pre-filled diluent cartridge is configured for being housed in a syringe-like housing as generally known in the art. This configuration allows the user to interface with the adapter as if it were a simple syringe and reduces the number of containers in the reconstitution process. The cartridge is typically a glass or autoclavable plastic container with butyl rubber stoppers that can allow for sterilization and/or preserve the diluent in a sterile condition for long periods. A break-away member 309 at the plunger rod 106 and syringe barrel 101 juncture is typically employed and prevents unintentional activation of the cartridge. A vial access device is attached to the luer of the syringe barrel, with a spike cover over the plastic vial access spike to preserve sterility.

In the figure descriptions, a cartridge consisting of a glass body, rubber seal with aluminum crimp and a butyl rubber stopper has been depicted. Various prefilled cartridges exist and could be used in this device concept. The cartridges may be filled with whatever diluent is required for a particular drug reconstitution.

Standard Syringe Interface

The embodiments of the syringe housing described herein may be designed such that they are able to mate with standard and non-standard off-the-shelf needles and needle-less valves.

Vial Adapter for Pre-Filled Cartridge

The vial adapter can be of any size required to match the drug vial finish, the standard 13 mm, 20 mm, and 28 mm or a custom size, and can be configured with or without a vent to relieve pressure build-up in the containers, or a fluid filter if required for a particular drug reconstitution. In addition the vial adapter may be configured in two parts that allow for the spike and cap to be assembled to the cartridge independently from the larger diameter shroud, facilitating high-volume handling of the cartridge in manufacturing and assembly. The shroud, which does not require sterility, could then be attached at a later stage.

The embodiments of the pre-fill syringe cartridge adapter described herein may alternately be equipped with other attachment means in place of the described shroud for securing the various containers such as but not limited to diluent bags and vials.

Alternate Access Means

The embodiments of the pre-fill syringe cartridge adapter described herein may alternately be equipped with other access means for mating and sealably connecting to various containers such as but not limited to diluent bags and vials.

Methods of Use of the Pre-Fill Syringe Cartridge Adapter

To reconstitute a lyophilized drug, the user would remove the spike cover of the vial access device and snap the adapter on to the top of the drug vial. The vial access device is configured for a low-force, permanent attachment. The user then removes the tab at the plunger of the syringe, which prevents unintentional activation, and depresses the plunger to inject the diluent into the vial. The initial movement of the plunger causes the internal diluent cartridge to be penetrated by a cannula so that it can be injected. The assembly can then be swirled normally to reconstitute the drug, with the vial adapter holding the syringe securely in place. When the drug is dissolved, the assembly can be inverted and the drug withdrawn into the syringe cartridge. A slot in the vial adapter allows the drug to be removed fully. The syringe can then be detached from the vial adapter at the luer lock connection, ready to be fitted with the appropriate needle for injection.

In some embodiments, an adapter configured for a pre-filled diluent syringe is provided. In one aspect, the prefilled diluent syringe functions as the cartridge in the above embodiment.

Vial Adapter for Pre-Filled Diluent Syringe

In some of the figure descriptions, a syringe consisting of a glass body, elastomeric plug and elastomeric syringe stopper has been depicted. Various prefilled syringes exist and could be used in this device concept. Alternate materials for the syringe barrel with high barrier properties and syringe fill compatibility could be used, such as cyclic olefin copolymers COC or cycloolefin polymer COP. Alternate elastomeric materials with good barrier properties and syringe fill compatibility could be used for the butyl rubber plug and stopper, such as Polyisoprene or SANTOPRENE™. The syringes may be filled with whatever diluent or content is required for a particular drug reconstitution or delivery.

Standard Syringe Interface

The embodiments of the adapters described herein may be designed such that they are able to mate with standard and non-standard off-the-shelf needles and needle-free valves. The shroud of the vial adapter can be of any size required to match the drug vial finish, the standard 13 mm, mm, and 28 mm or a custom size, and can be configured with or without a vent to relieve pressure build-up in the containers, or a fluid filter if required for a particular drug reconstitution. In addition the adapter may be configured in two parts that allow for the spike and spike cover to be assembled to the syringe independently from the larger diameter shroud which allows the assembly to stay within the diameter of the syringe barrel so that the syringe can be hung by the flange, facilitating high-volume handling of the syringe in manufacturing and assembly. This also accommodates ready-to-fill tub design. The shroud, which typically does not require sterility, could then be attached at a later stage so as to facilitate mechanical handling of the prefill devices without the added girth or diameter of the shroud.

In some embodiments, the present disclosure provides for a pre-filled syringe vial adapter, which couples to a prefilled syringe barrel, sealed on the distal end with a plug and on the proximal end with a stopper which may be butyl rubber or other elastomeric materials compatible with the long-term storage of the syringe's contents, the proximal stopper being configured as a sliding syringe plunger. A plunger rod, which may be removable, temporary, permanent or user attachable, is fixed to a stopper. The distal plug is captured in a luer connector by a cap and is attached to the prefilled syringe distal end by a luer lock collar. A vial adapter consisting of an adapter body, a spike, a central attachment means, an internal fluid path, and optionally a penetrating cannula or valve, is slidably attached to the cap by means of features on the outer diameter of the cap and flexible tabs on the body of the vial adapter with openings that interact with the adapter body features creating a first position and a second position. A spike cover on the spike and optionally a plug covering the penetrating cannula maintains the sterility of the fluid path. A vial adapter shroud, sized to attach to the required vial top, attaches to the central attachment means of the vial adapter with snap fingers or the like.

In some embodiments, the spike cover is removed and the spike is positioned above the drug vial septum, which can be assisted by the shroud. The adapter is then pressed down onto the drug vial to access the vial. As force is applied, the cap moves to the second position causing the penetrating cannula to pass through the plug. This movement is small and requires a low force compared to the force required to pierce the larger drug vial septum and snap on the vial adapter shroud.

An alternative configuration of the adapter is compatibility with a prefilled syringe barrel, sealed on the proximal end with a stopper which may be butyl rubber or other elastomeric materials compatible with the long-term storage of the syringe's contents, the proximal stopper being configured as a sliding syringe plunger. A plunger rod, which may be removable, temporary, permanent or user attachable, is fixed to the stopper. The adapter can be attached to the distal end of the syringe with a luer lock collar. A seal of butyl rubber or other elastomeric material or blend of materials is captured inside the luer fitting to ensure a complete seal. Alternately the seal may be made by a thermoplastic female luer against the syringe male luer, and thus integral to the adapter with no need for a separate elastomer component. A spike cover, also of a butyl or butyl-like elastomeric material, on the adapter spike maintains the storage life of the contents and the sterility of the fluid path. An adapter shroud, sized to attach to the required vial top, attaches to the central attachment means of the adapter with snap fingers.

In another alternate configuration of the pre-filled syringe vial adapter, a vent is added to the configuration with a vent lumen passing through the spike, co-axial and separate from the fluid lumen, in connection with a vent port, which is covered with a vent filter media. The vent filter media may be a hydrophobic material to prevent leaking of fluid from the adapter, and may have orifices of 0.2 microns or less in cross section providing a sterile barrier to the outside air. A filter configuration could be used with either of the presently described devices.

For all configurations of the adapter for pre-filled syringe devices, once the connection to the drug vial is made an open fluid path is created from the prefilled syringe to the drug vial and the diluent may be transferred into the drug vial by depressing the syringe plunger rod. The drug in the vial can be reconstituted and withdrawn into the prefilled syringe, which is then detached from the vial adapter luer connection for delivery. This configuration reduces the number of steps, containers and needles in the reconstitution process, simplifying reconstitution for the user and increasing safety.

The following is a description of the figures and associated features of each embodiment of the enclosed disclosure.

With reference to FIGS. 1, 2A, 2B, 2C, 2D, an exploded view and various sectional views of conventional reconstitution device coupled to an adapter embodiment of the present disclosure is shown. Thus, conventional pre-fill syringe device comprises plunger rod 106 retention ring 99, engageable with pre-fillable cartridge 50 having stopper 105 and crimped penetrable seal 55 coupled to Luer adapter 59 having male Luer 102. Cartridge assembly 50 is received by syringe barrel 101 having retaining feature 70 to prevent release or movement of cartridge 50 during use. Tab 60, configured for removal by end-user, prevents inadvertent movement of plunger rod 106 prior to use. Adapter 199 comprises upper adapter body 210 having coupling member 111 shown with cylindrical sidewall, the sidewall terminating with threaded fittings for attachment to Luer adapter of prefilled syringe device, and the adapter body 210 coupled to central portion 113 having projecting spike 112 extending from the central portion 113 in a direction opposed to that of the coupling member 111. Spike 112 includes at least one conduit 114 which allows fluid communication through the central portion 113 and coupling member 111. Adapter assembly 200 further includes vial locking shroud 121 having receiving means 122 with locking tabs 123 engageable with central portion 113 to secure adapter 199 to shroud 121. Spike 112 is sealed by spike cover 120 which can provide liquid tight seal for adapter 199. Adapter 199 can be packaged separately or in a kit with shroud 121.

Referring to the sectional views 2B and 2D, penetrating cannula 115 is incorporated into Luer adapter 59 for penetrating seal 55 of cartridge 50 upon activation of the device by translating plunger rod 106 and urging the contents of cartridge 50 through spike conduit 114. Prefilled syringe device can be assembled with adapter 199 without the shroud 121 so as to facilitate ease of adaptation with conventional filling and packaging machines. Adapter 199 with spike cover 120 provides a septic seal compatible with sterilization techniques. To use adapter 199, shroud 121 can be connected, spike cover 120 removed, spike 112 inserted into a vial containing reconstitutable medicament whereby shroud 121 will lock the vial in place. Removing locking tab 60 and urging plunger rod 106 releases contents of cartridge 50 by forcing penetrating cannula 115 through seal 55 allowing fluid communication with spike conduit 114. After reconstitution, the contents of the valve can be withdrawn back into the cartridge 50 by drawing back on plunger rod 106.

Referring now to FIGS. 3, 4A, 4B, 4C, 4D an alternate embodiment of the adapter is shown, suitable for use with prefilled syringes, in this example, without cartridge 50. Thus, adapter 300 shown in an exploded view comprises coupling member 107 having exemplary Luer threading on one end and adapted to receive elastomeric plug 103 which is contained in coupling member 107 via cover 108 coupled to other end of coupling member 107. Cover 108 includes extending tab features 116 as well as an opening to receive penetrating cannula 115 which is mounted in adapter body 110. Coupling member 107 elastomeric plug 103 and cover 108 are received by adapter body 110. Extending tab features 116 engage openings 118 first operational state, and engage openings 119 in a second operational state in adapter body 110. Adapter body 110 projects from central portion 113. Spike 112 projects opposed to adapter body from central portion 113. Central portion 113 accepts spike cover 120. Central body 113 is configured to be received by shroud 121 via coupling members 122 having tabs 123. Adapter body includes coupling member 211 and flexible tabs 117 for allowing extending tabs 116 to easily translate from openings 118 to openings 119 during transition from the first operational state to the second operational state.

Figure 4A:
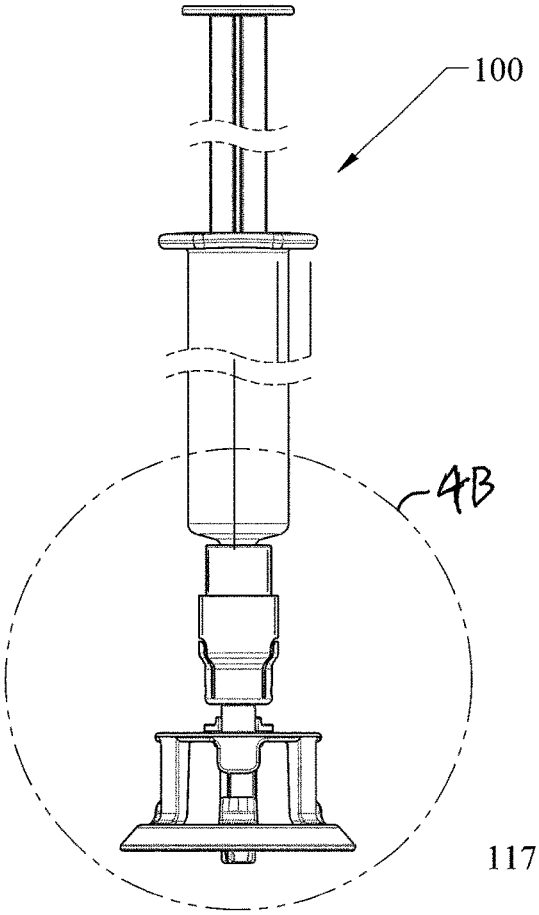
FIG. 4A is a perspective view of the adapter of FIG. 3 assembled to a prefilled syringe device.
Figure 4B:
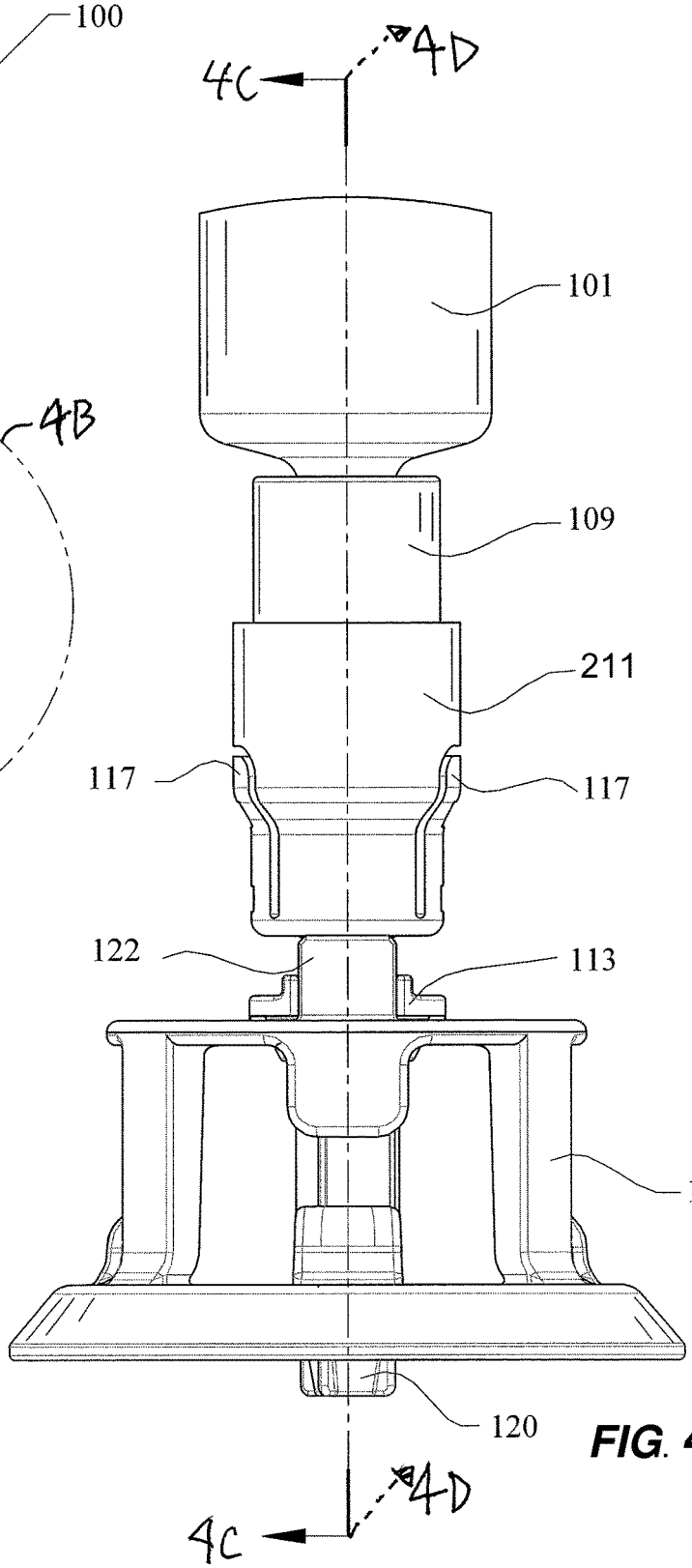
FIG. 4B is a sectional view of section 4B of the adapter of FIG. 3.
Figure 4C:
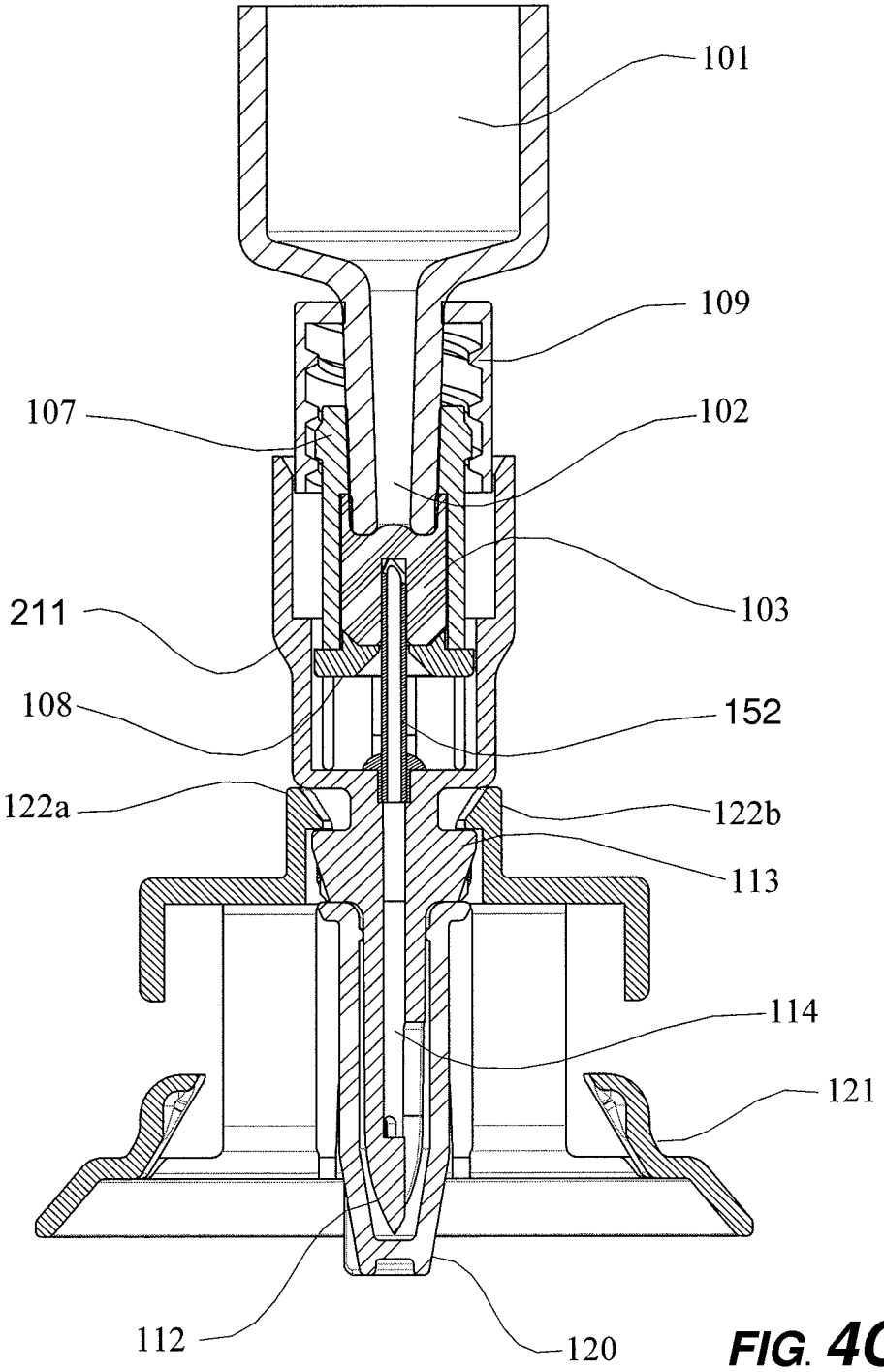
FIG. 4C is a sectional view along section line 4C-4C of the adapter of FIG. 3.
Figure 4D:
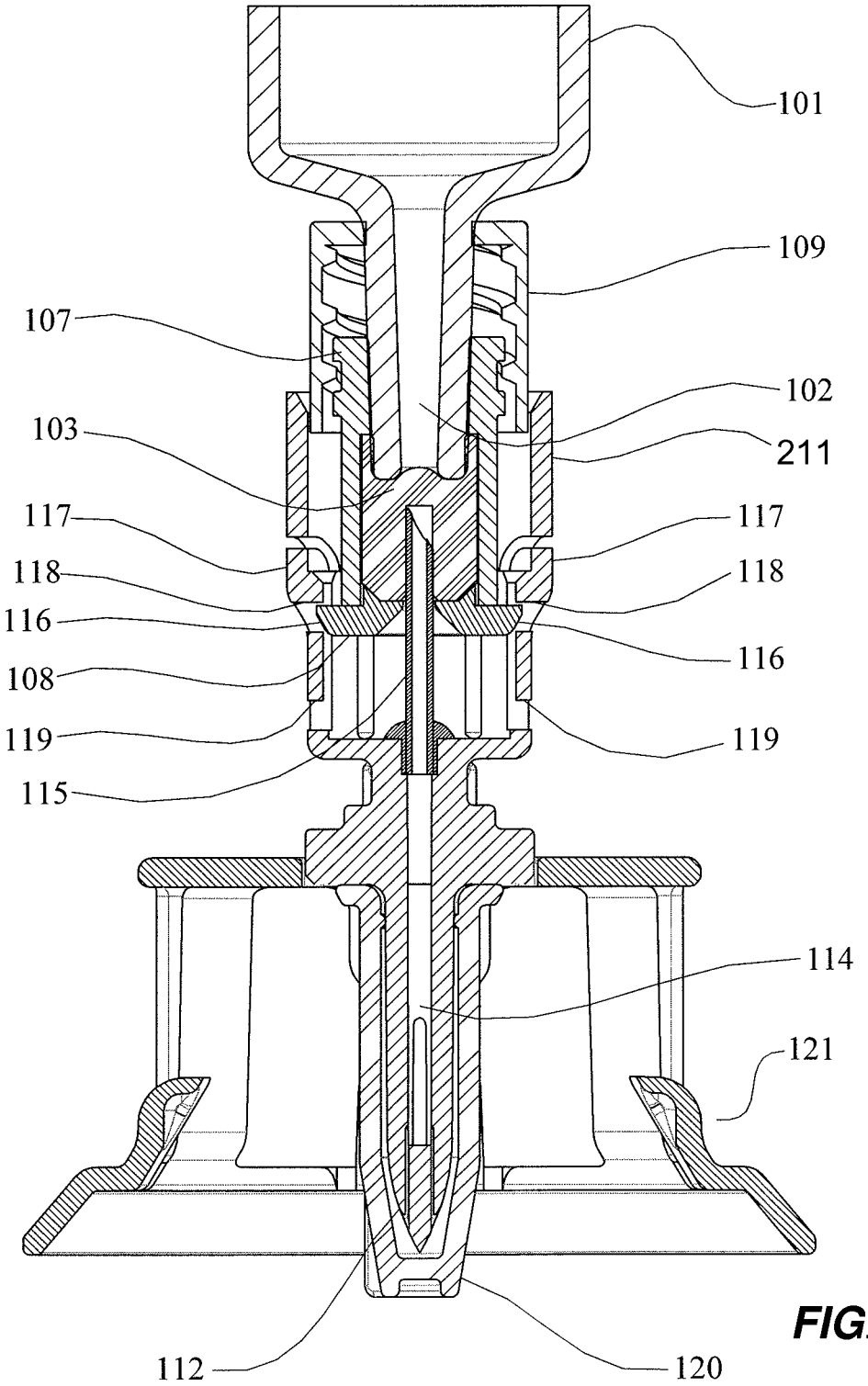
FIG. 4D is a sectional view along section line 4D-4D of the adapter of FIG. 3.
Figure 4E:
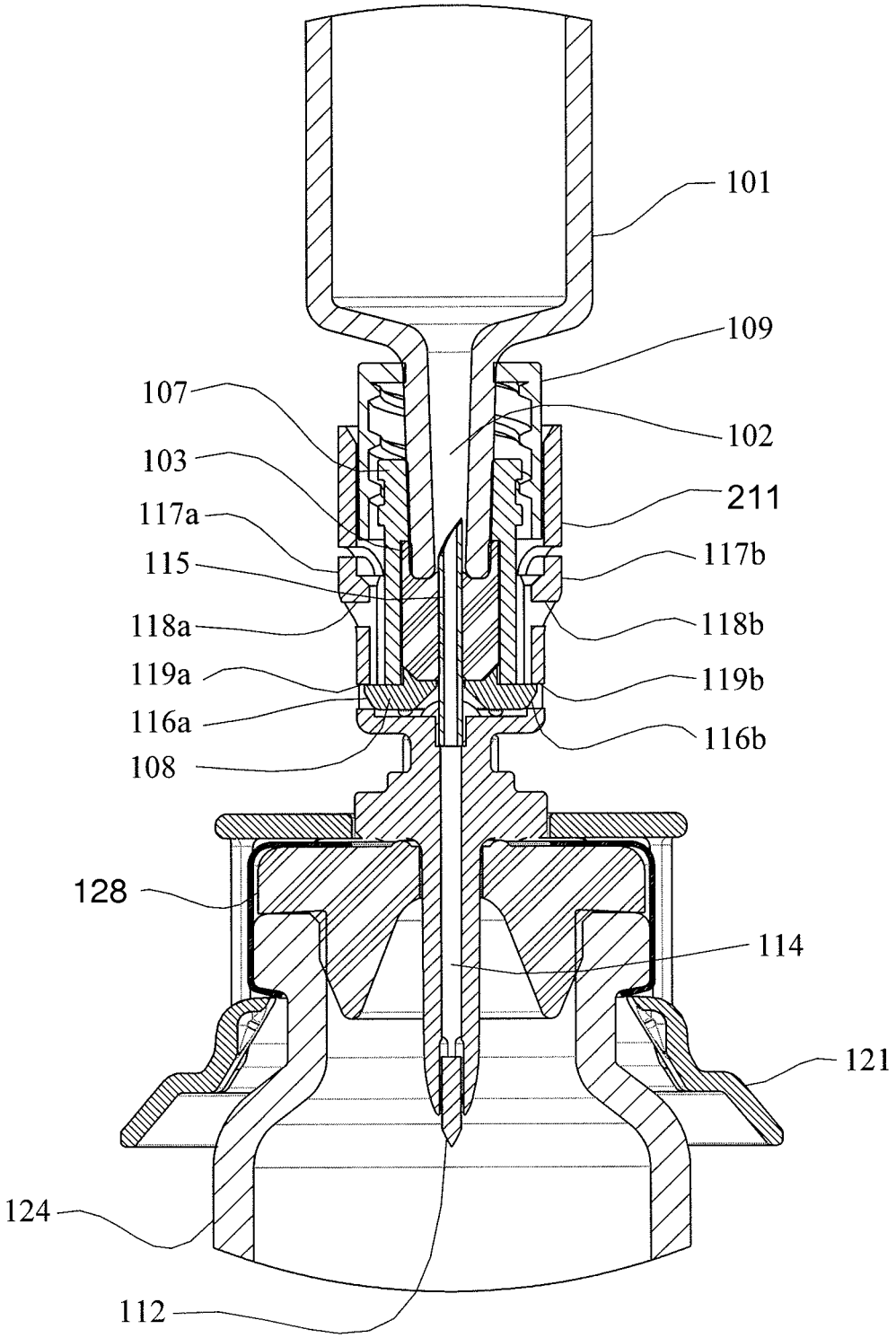
FIG. 4E is a sectional view along section line 4D-4D of the adapter of FIG. 3 shown in a second state of operation.

As shown in FIGS. 4C, 4D, and 4E, penetrating cannula 115 is mounted in coupling member 107 and aligned with conduit 114. To use adapter 200, Luer adapter 109 of prefilled syringe device is engaged with coupling member 107 elastomeric plug 103 to compress and allow penetrating cannula 152 to pierce through elastomeric plug 103 to allow fluid flow between spike conduit 114 and prefilled syringe Luer 102. Extending tab features 116 translate from first openings 118 to second openings 119 during the transition from first operational state to second operational state thus providing a continuous, two-way fluid path between prefilled syringe device and vial 124 or other container pierced by spike 112. The second openings 119 hold the penetrating cannula 152 in a piercing relationship with elastomeric plug 103 by accepting extending tab features 116 in the second operational state.

Figure 5A:
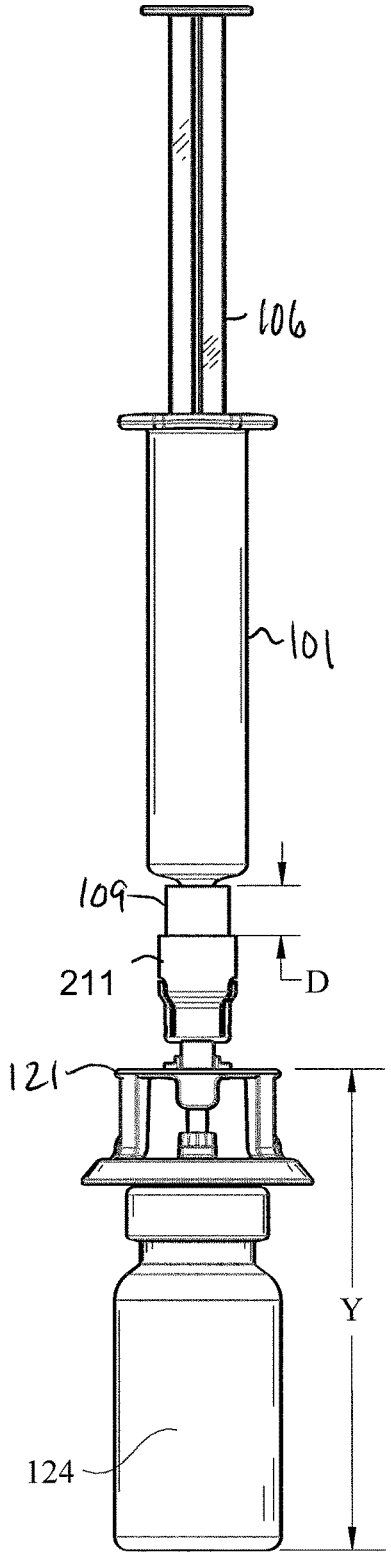
FIGS. 5A, 5B, and 5C are perspective views of the adapter of FIG. 3 during use.
Figure 5B:
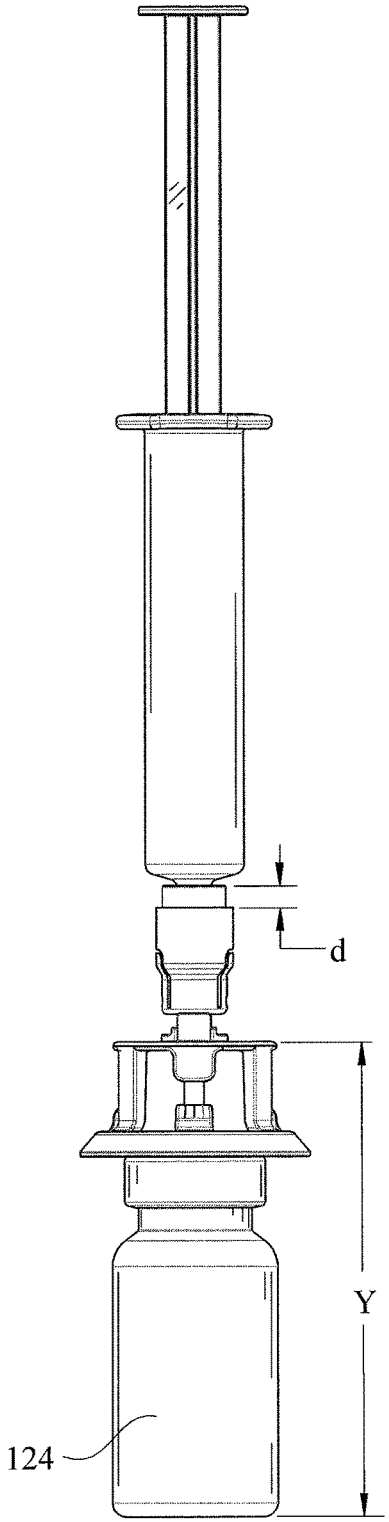
Figure 5C:
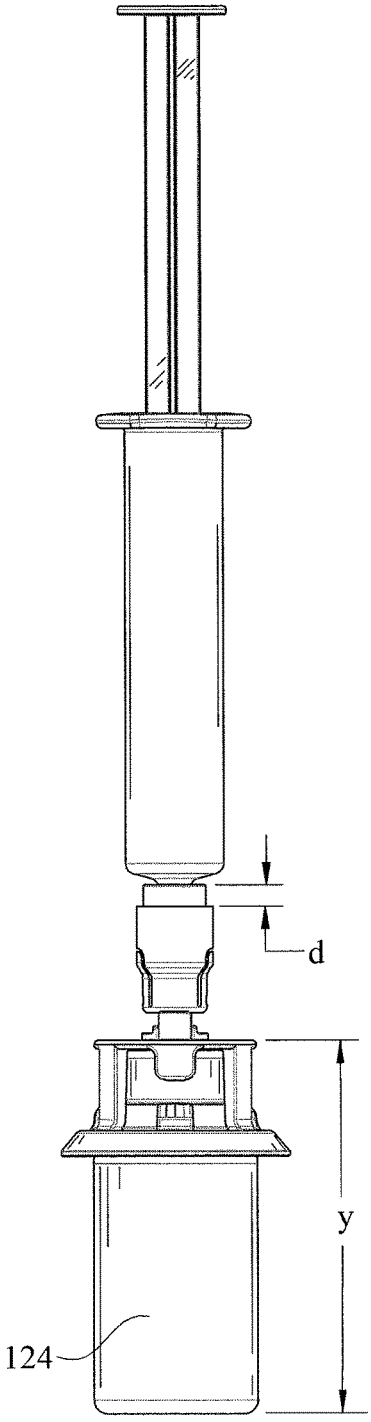

FIGS. 5A, 5B, 5C show perspective use of the mode of operation of adapter 200 whereas the top of shroud 121 of adapter 200 is arranged above vial 124 a distance Y, with coupling member 107 spaced a distance D upon initial engagement with Luer adapter 109 of prefilled syringe device barrel 101. Complete coupling of Luer adapter 109 of prefilled syringe device and coupling member 211 reduces distance D to distance "d" in second operational state. Exerting a downward force on shroud 121 allows spike 112 to penetrate and access contents of vial 124 reducing distance Y to "y". The sequence depicted in FIGS. 5B and 5C can be performed in reverse order.

Figure 5D:
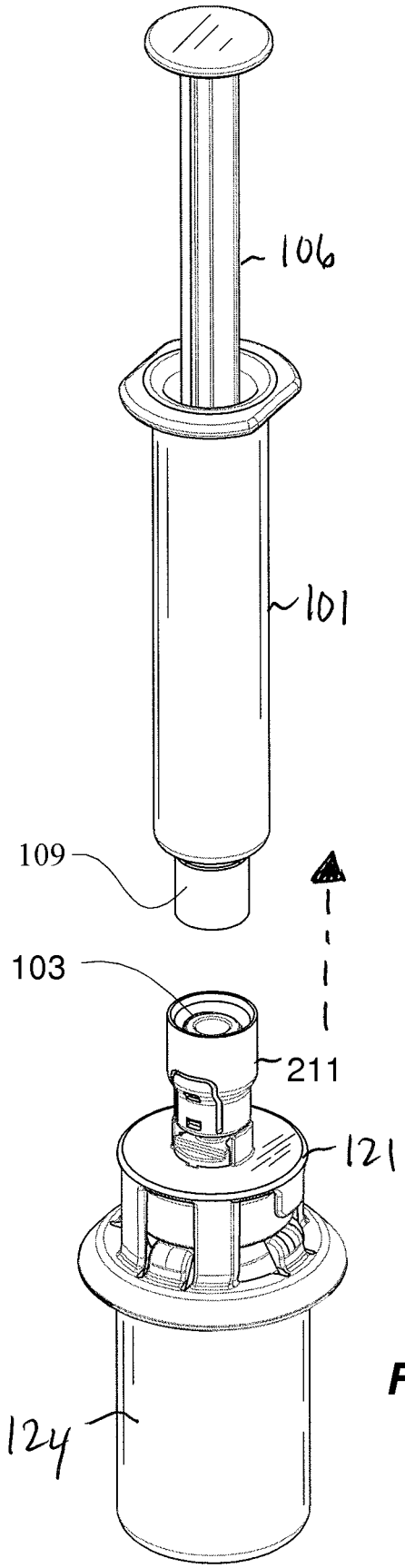
FIG. 5D is a perspective view of the adapter of FIG. 3 during use.
Figure 6:
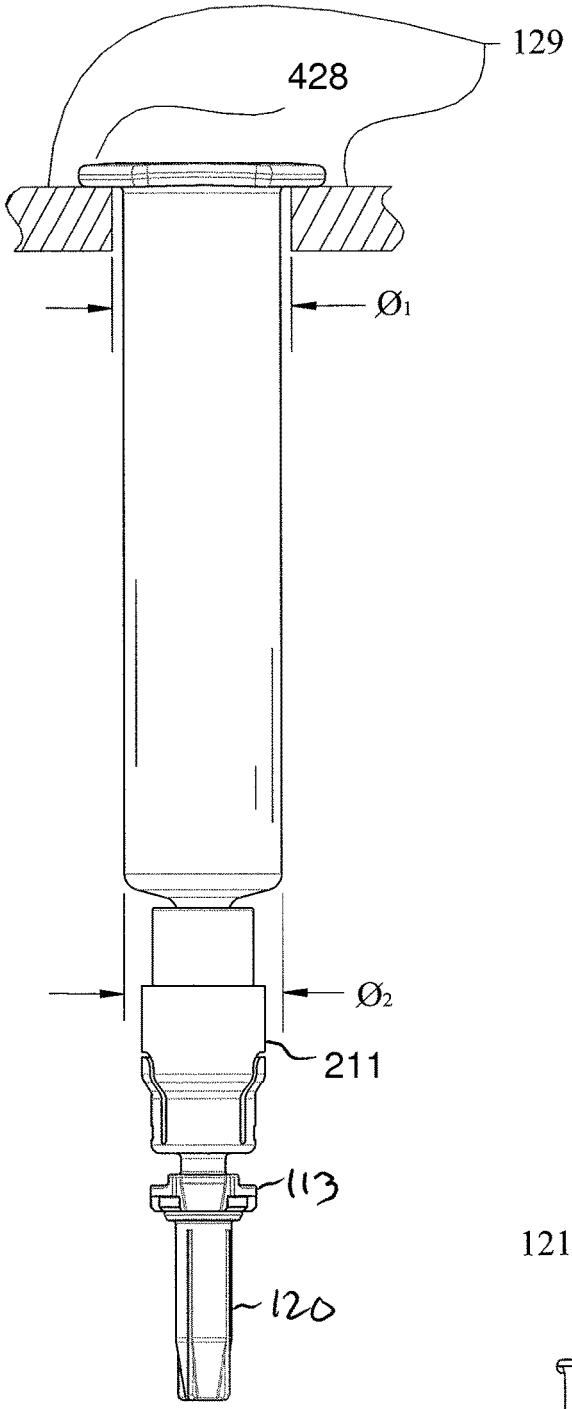
FIG. 6 is a perspective view of the adapter of FIG. 3 shown in an assembly process.

FIG. 5D shows an exploded view of the prefilled syringe device being released from adapter 200 with reconstituted contents. Coupling member 211 comprises a generally cylindrical sidewall sized to receive Luer adapter 109 of prefilled syringe device. In one aspect, the cylindrical sidewall of coupling member 211 larger than the outer diameter of Luer adapter 109 but less than the outer diameter of syringe barrel 101 and flange is 428 of syringe barrel 101 to facilitate ease of manufacturing (as shown in FIG. 6).

Figure 7:
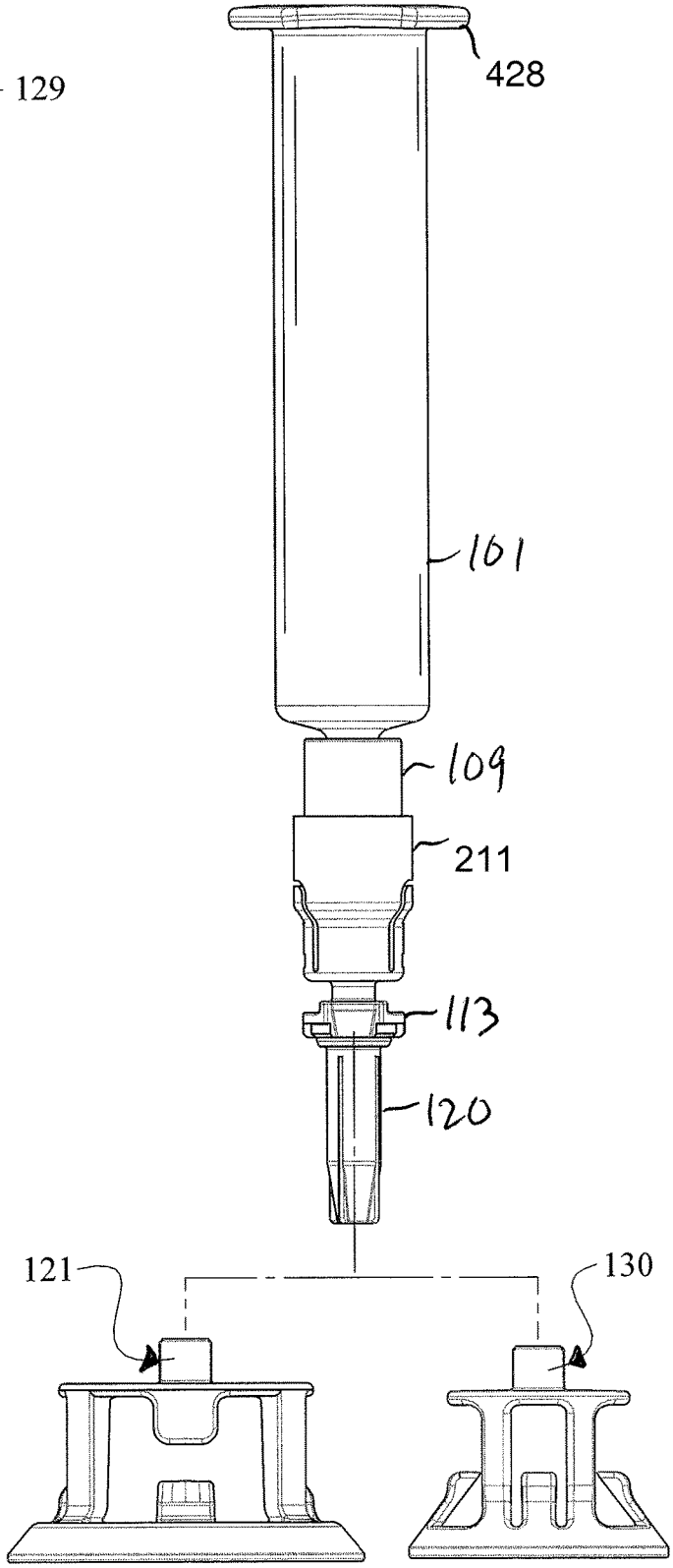
FIG. 7 is a dual exploded view of the adapter of FIG. 3 with shrouds of alternate diameters.

FIG. 7 depicts the coupling of adapter 200 with different sized shrouds 121, 130, adapted for different sized vials.

Figure 8A:
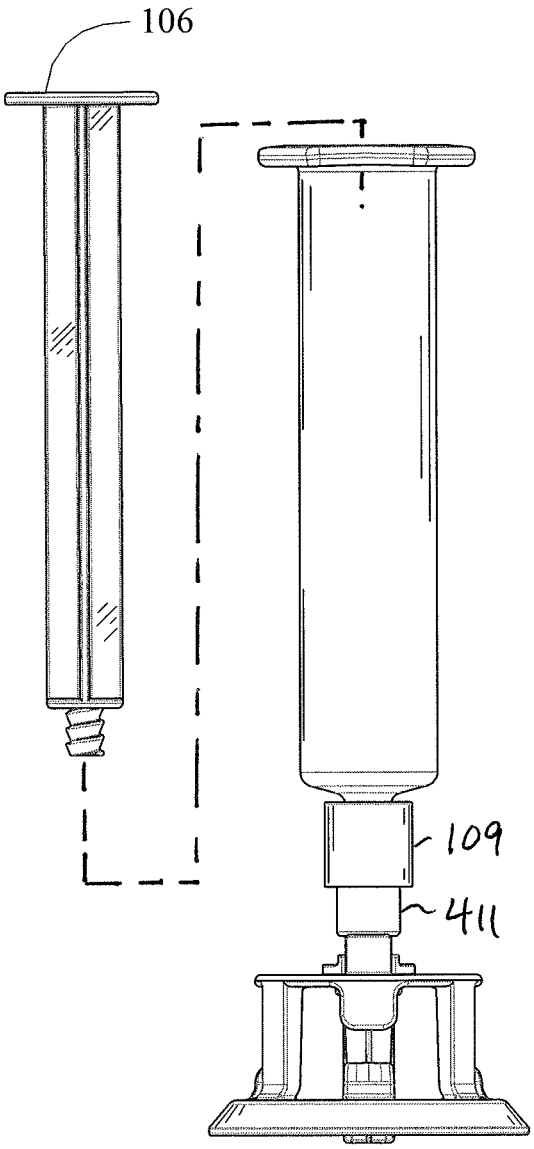
FIG. 8A is a partial exploded view of another adapter embodiment disclosed and described herein.
Figure 8B:
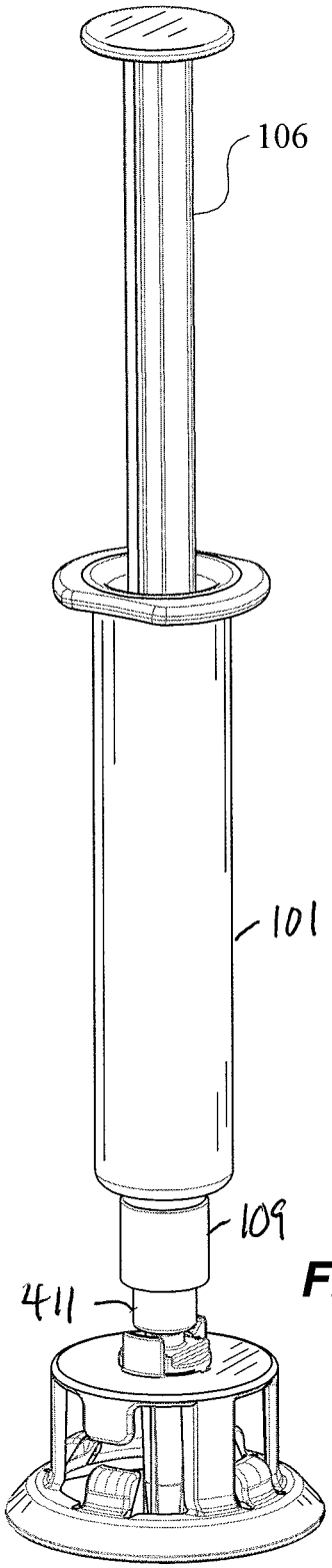
FIG. 8B is a perspective view of the adapter embodiment of FIG. 8A assembled to a prefilled syringe device.
Figure 8C:
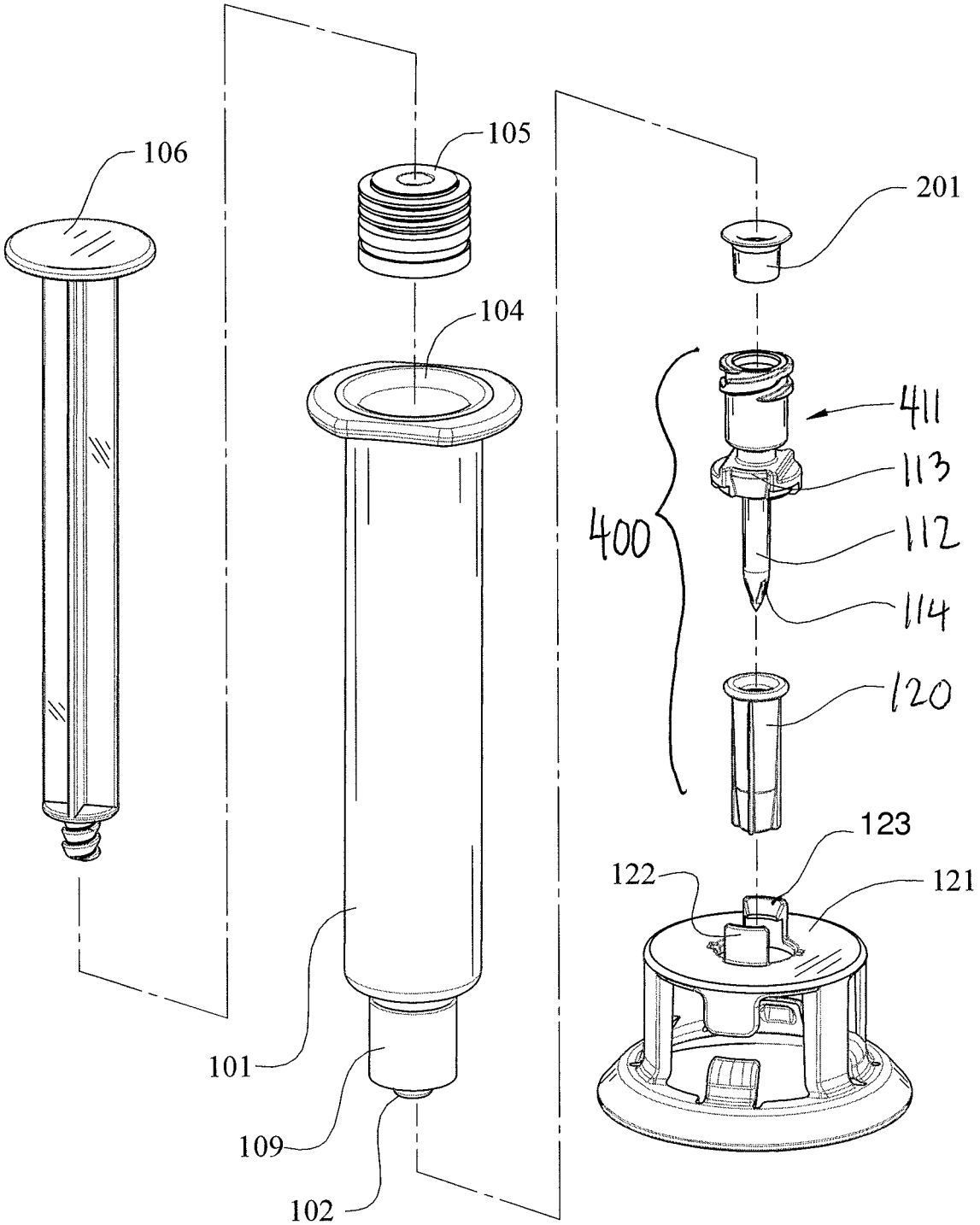
FIG. 8C is an exploded view of the adapter embodiment of FIG. 8A assembled to a prefilled syringe device.
Figure 8D:
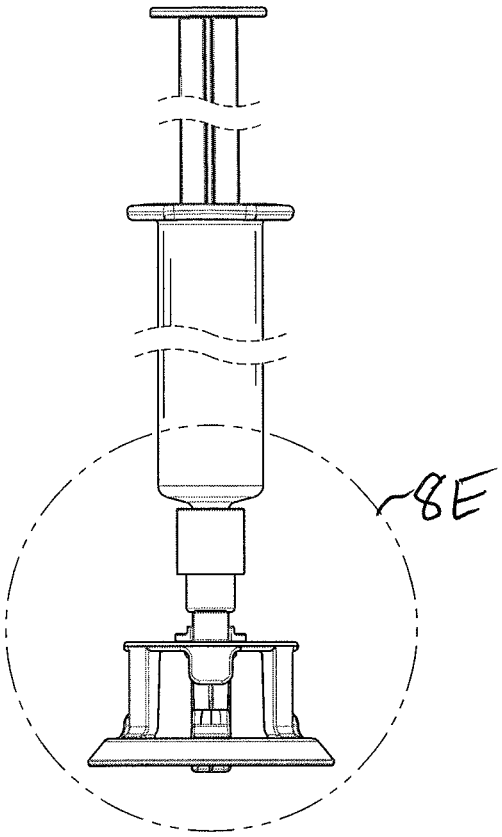
FIG. 8D is a perspective view of the adapter of FIG. 8A assembled to a prefilled syringe device.
Figure 8E:
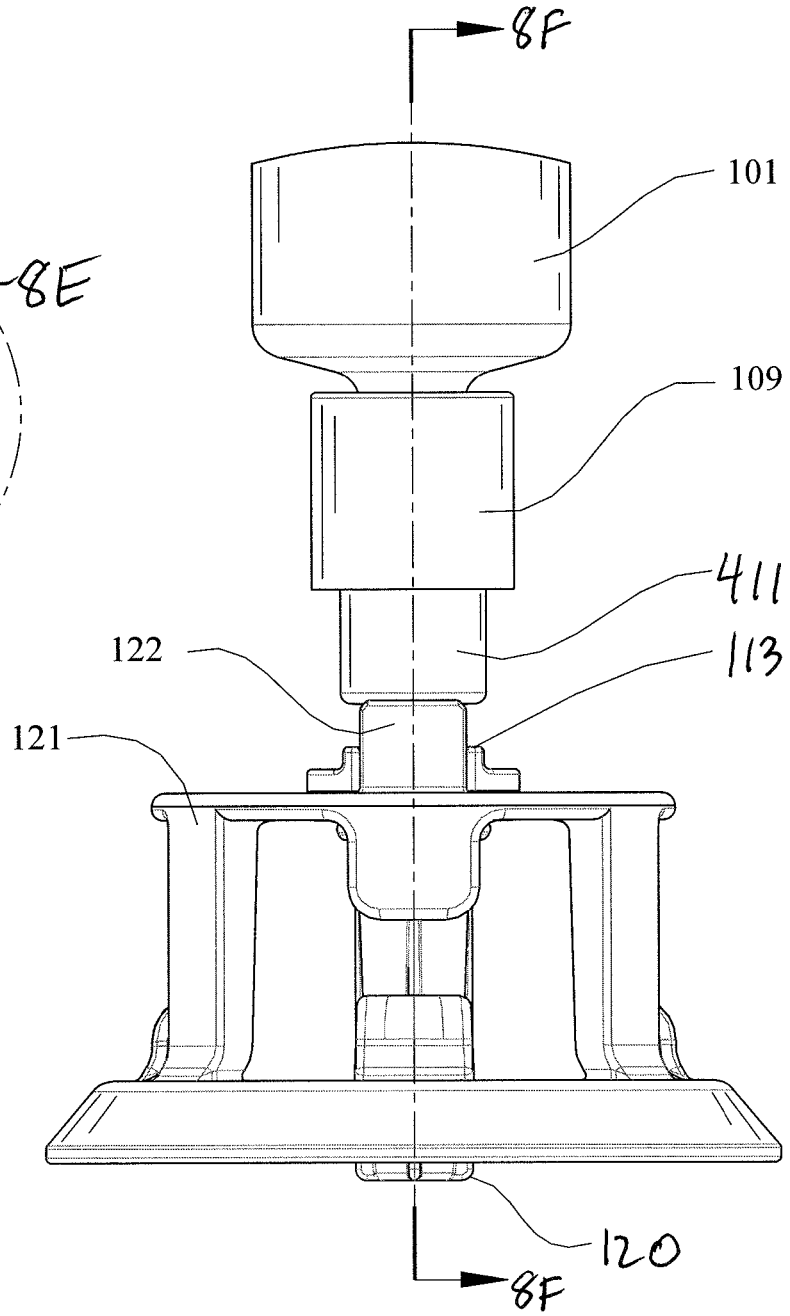
FIG. 8E is a sectional view of section 8E of the adapter of FIG. 8A.
Figure 8F:
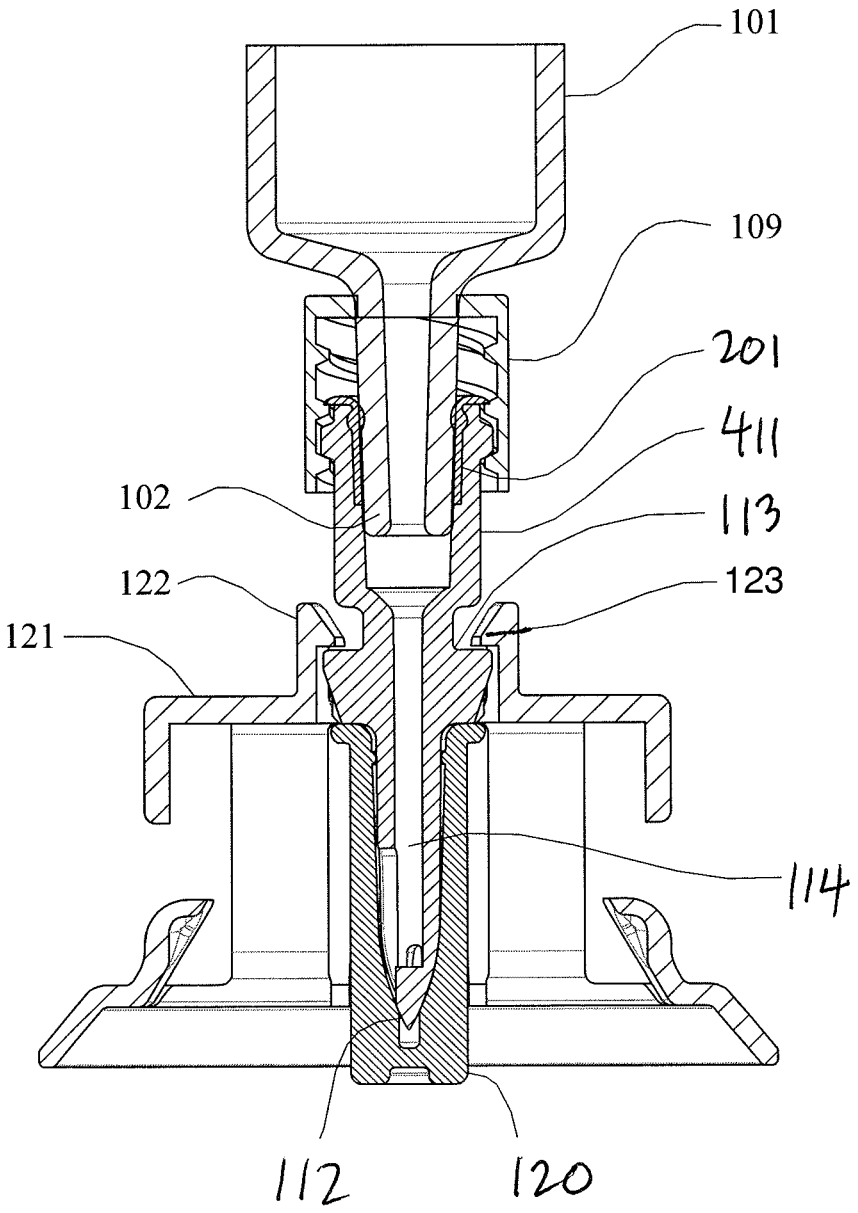
FIG. 8F is a sectional view along section line 8F-8F of the adapter of FIG. 8A.
Figure 9A:
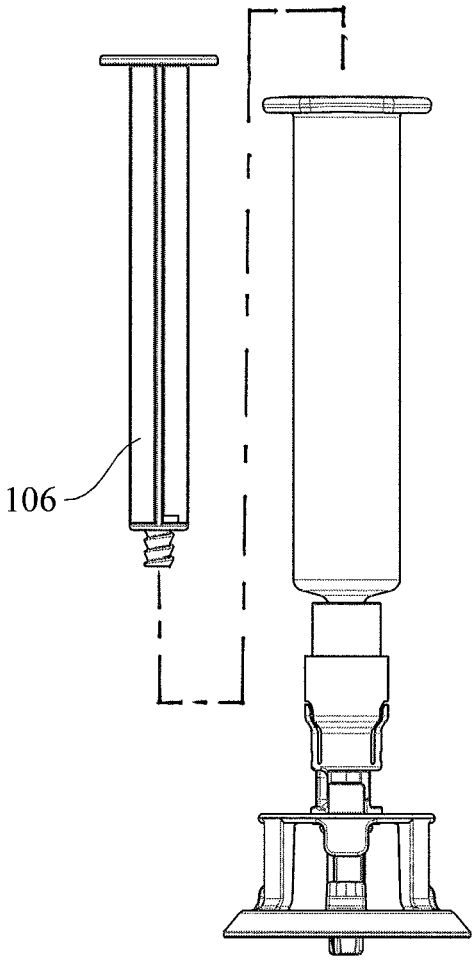
FIG. 9A is a partial exploded view of another embodiment of an adapter disclosed and described herein.
Figure 9B:
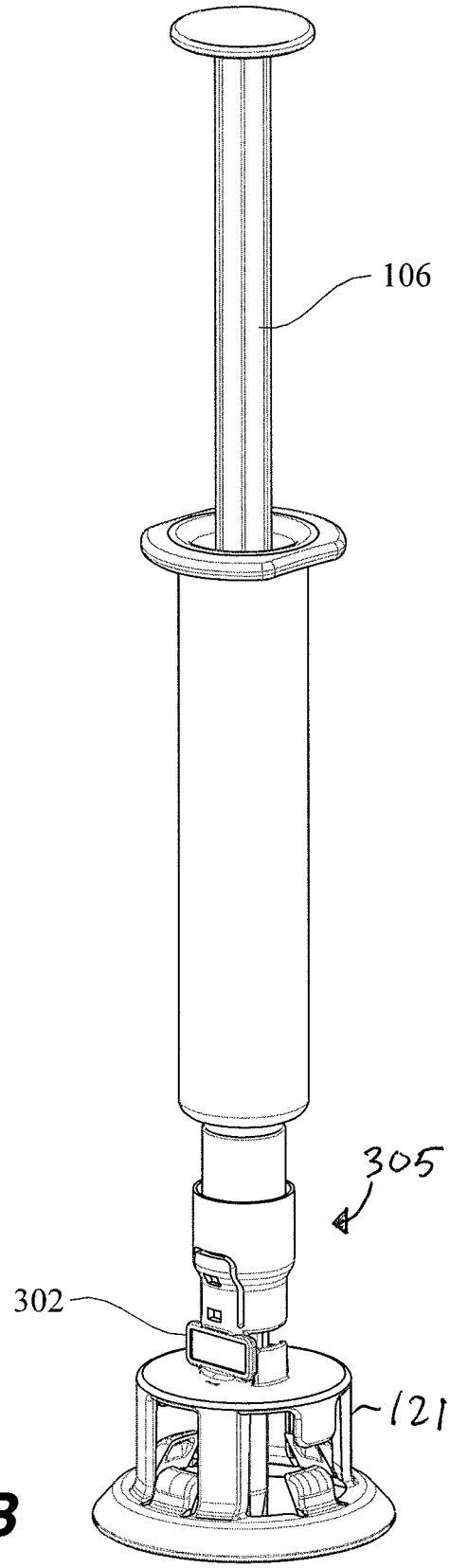
FIG. 9B is a perspective view of the adapter embodiment of FIG. 9A assembled to a prefilled syringe device.
Figure 9C:
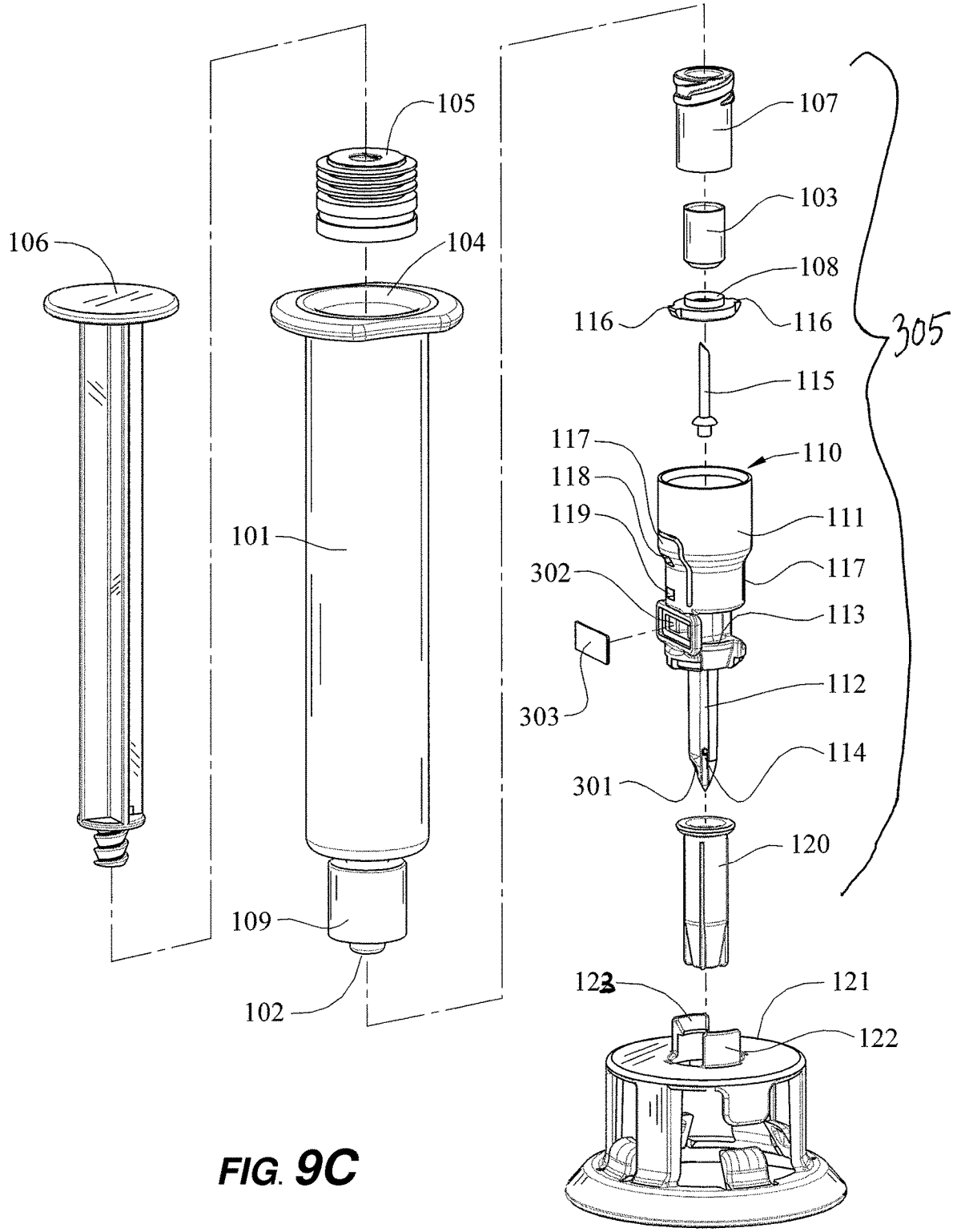
FIG. 9C is an exploded view of the adapter embodiment of FIG. 9A assembled to a prefilled syringe device.
Figure 9D:
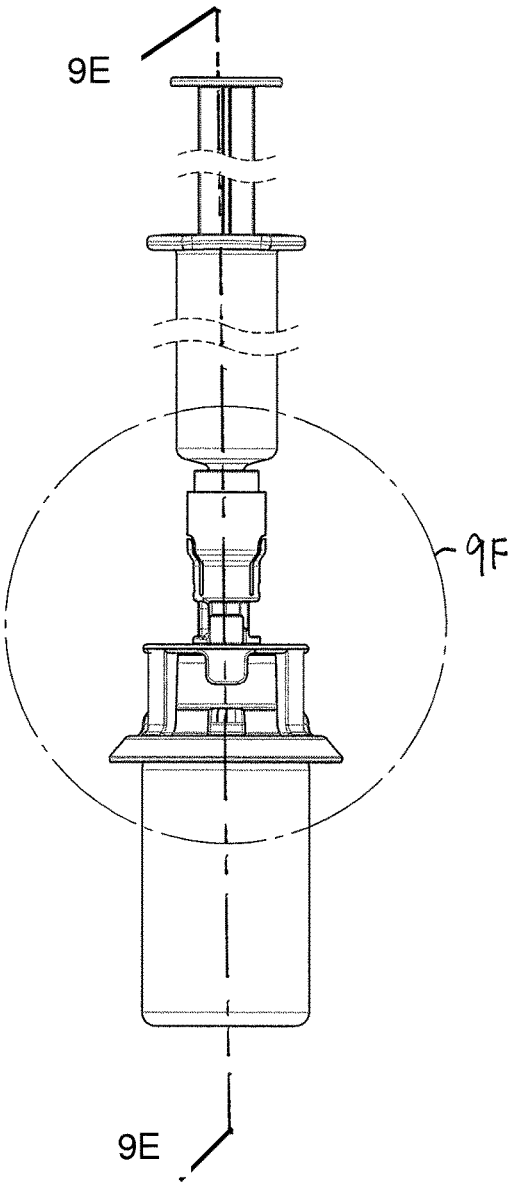
FIG. 9D is a perspective view of the adapter of FIG. 9A assemble to a prefilled syringe device.
Figure 9E:
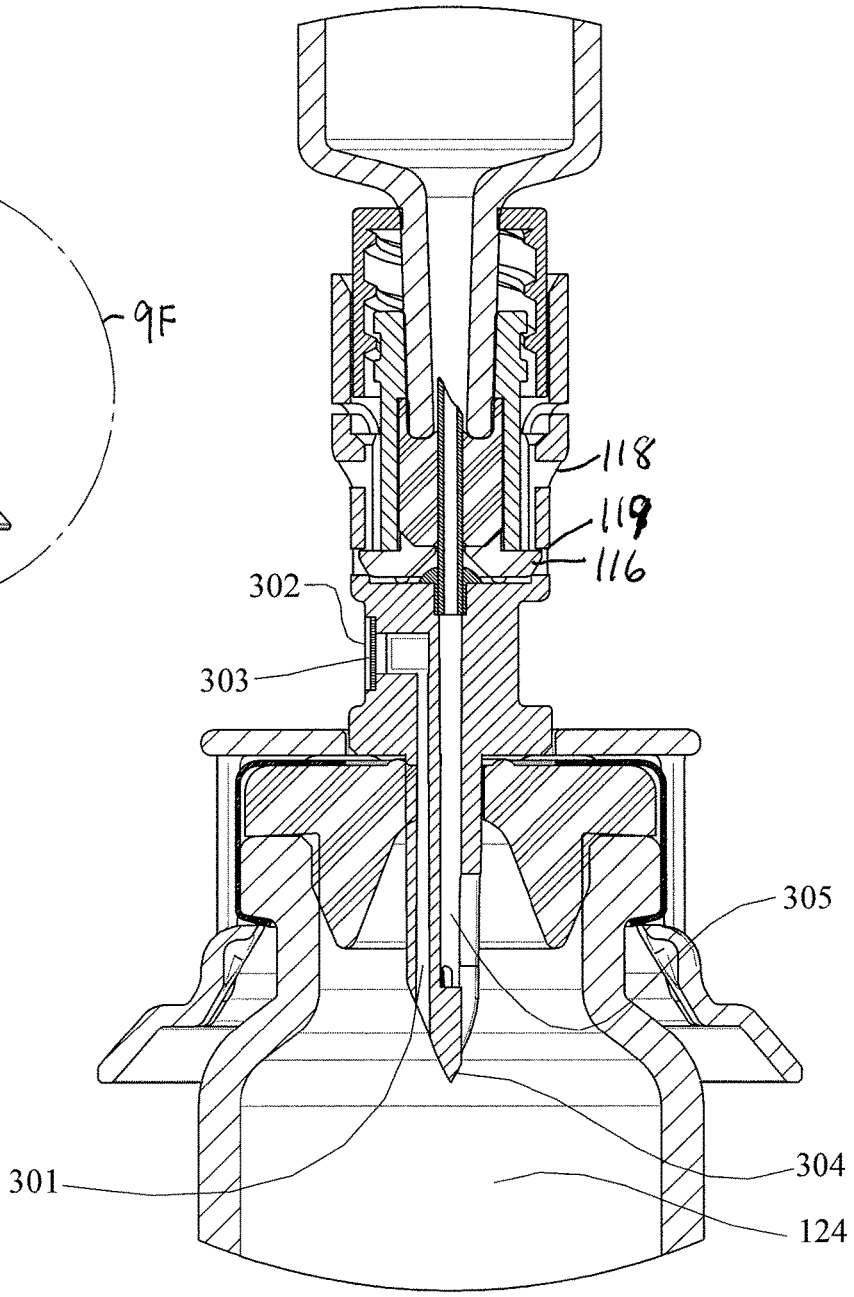
FIG. 9E is a partial sectional view of section 9E of the adapter of FIG. 9D.
Figure 10A:
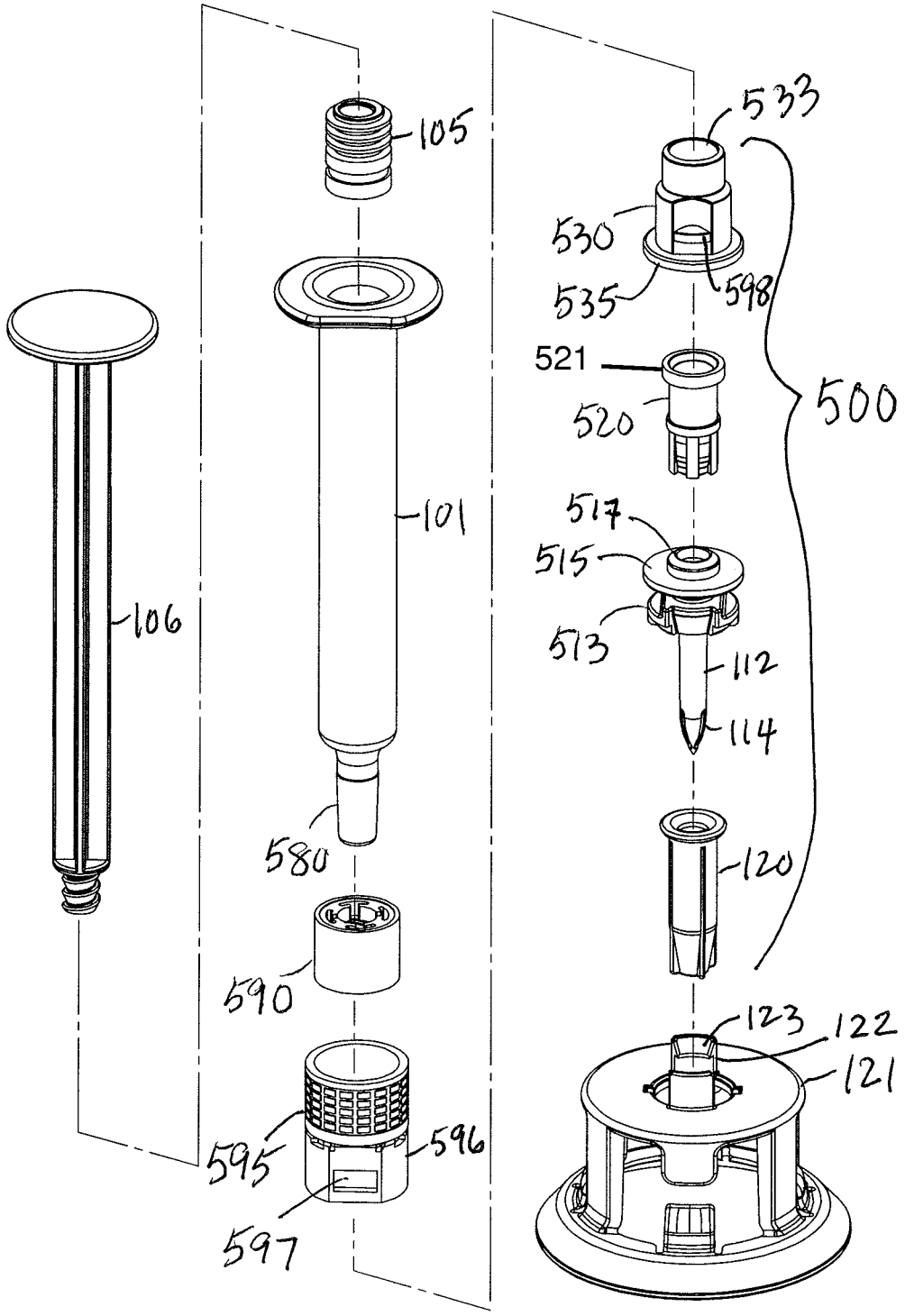
FIG. 10A is an exploded view of another adapter embodiment disclosed and described herein.
Figure 10B:
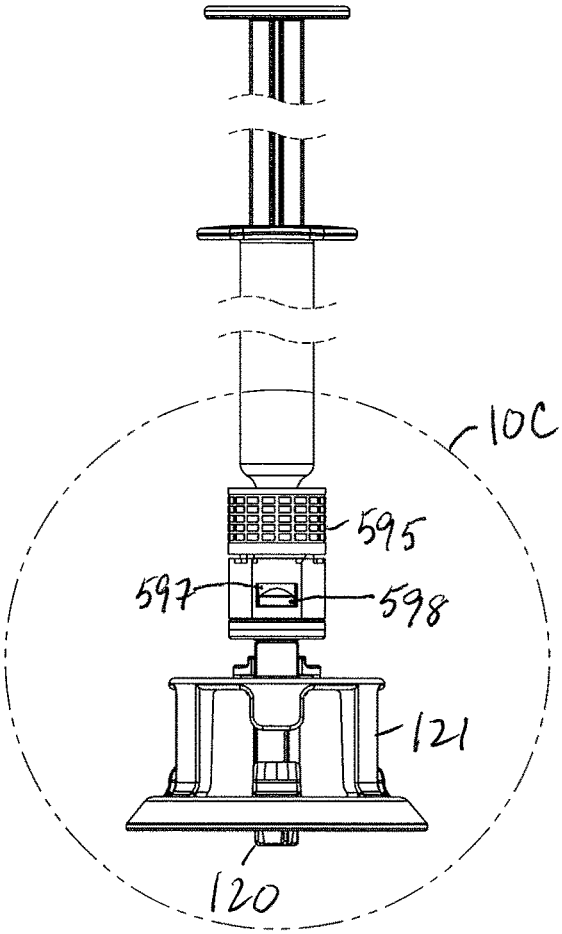
FIG. 10B is a perspective view of the adapter embodiment of FIG. 10A assembled to a prefilled syringe device.
Figure 10C:
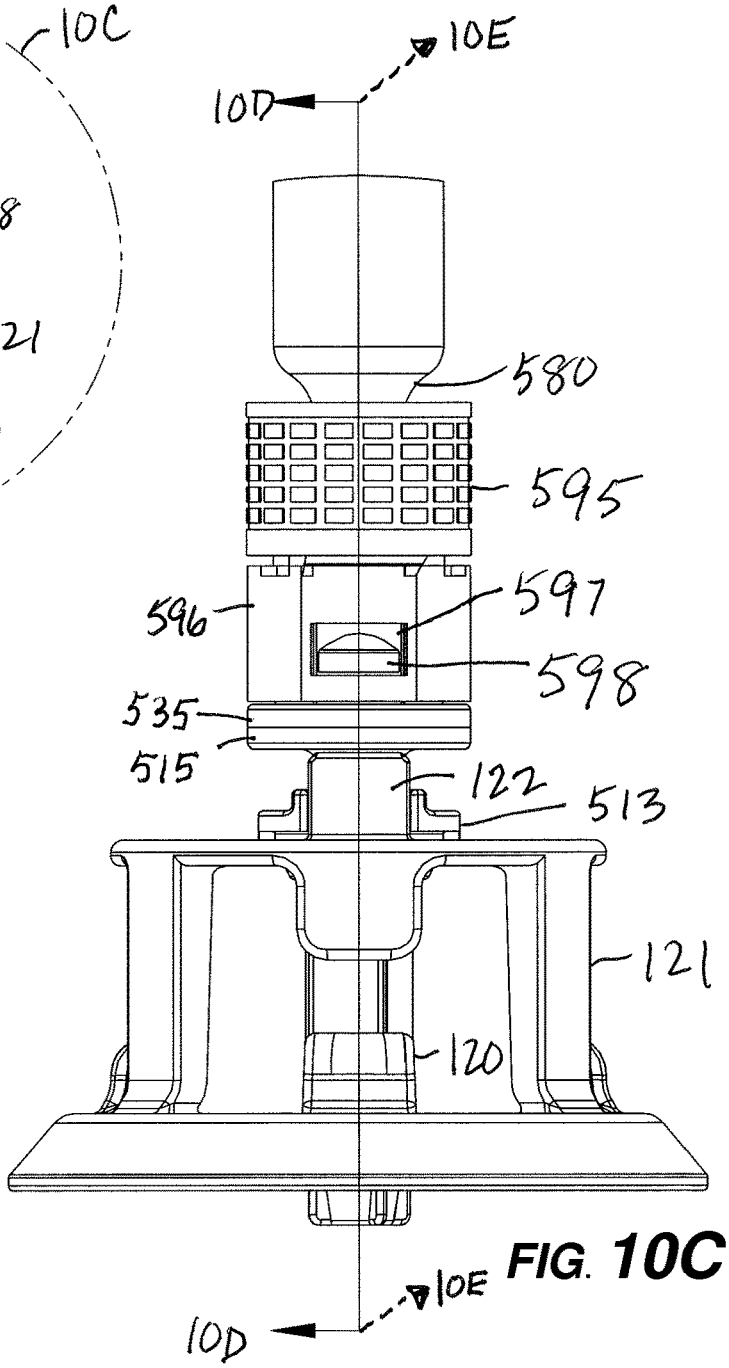
FIG. 10C is a partial view of section 10C of the adapter of FIG. 10B.
Figure 10D:
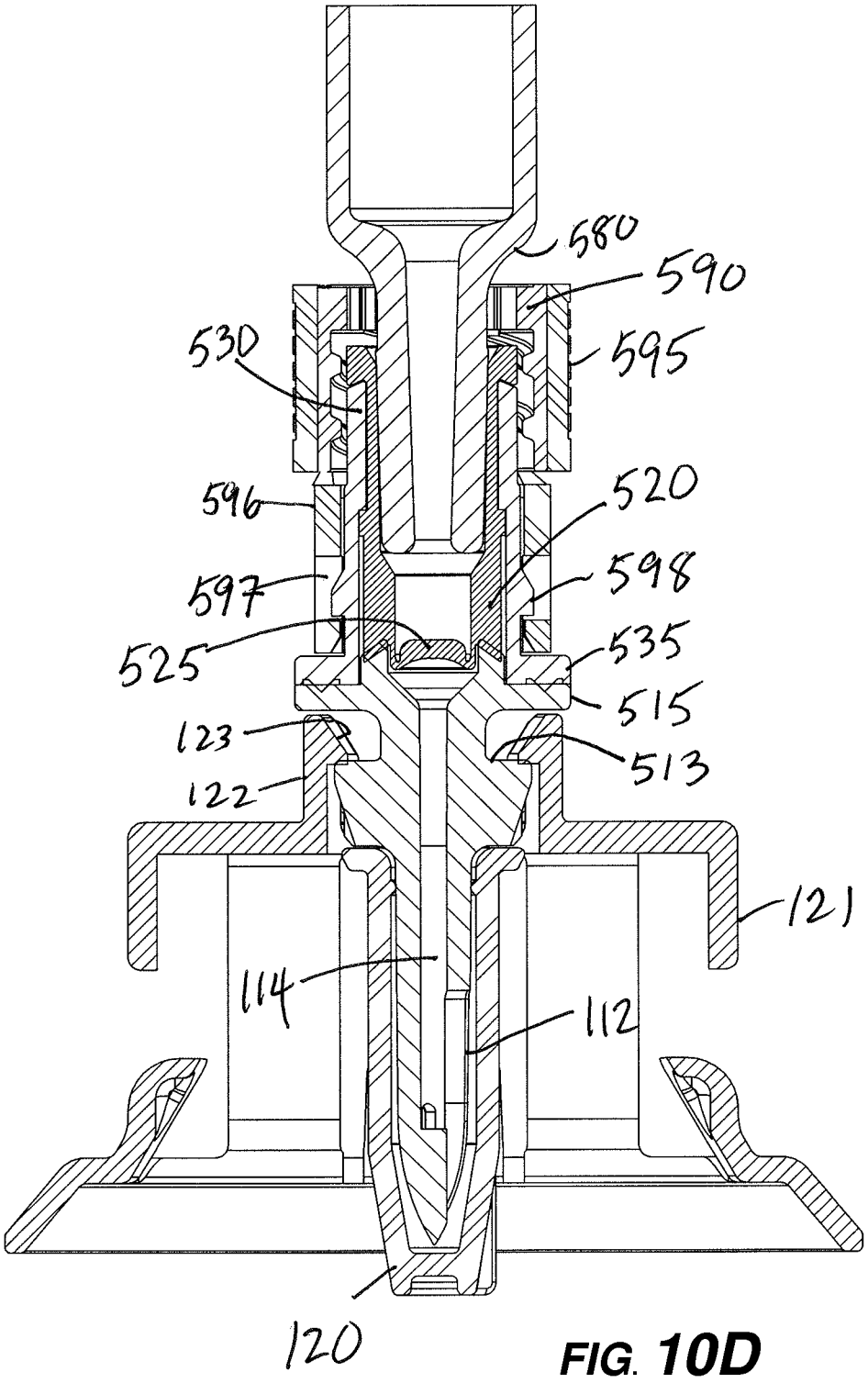
FIG. 10D is a partial sectional view along section line 10D-10D of the adapter of FIG. 10C.
Figure 10E:
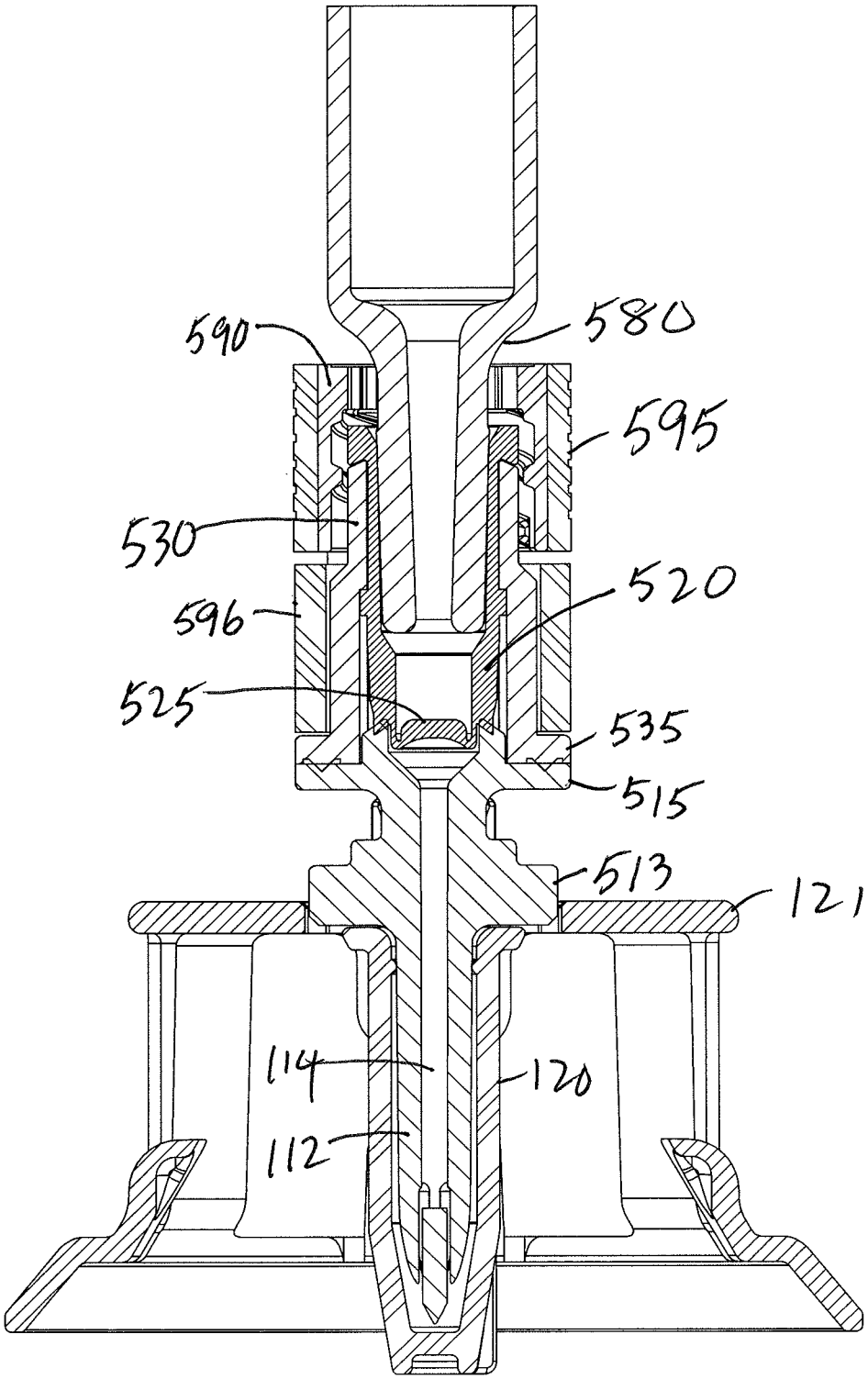
FIG. 10E is a partial sectional view along section line 10E-10E of the adapter of FIG. 10C.
Figure 10F:
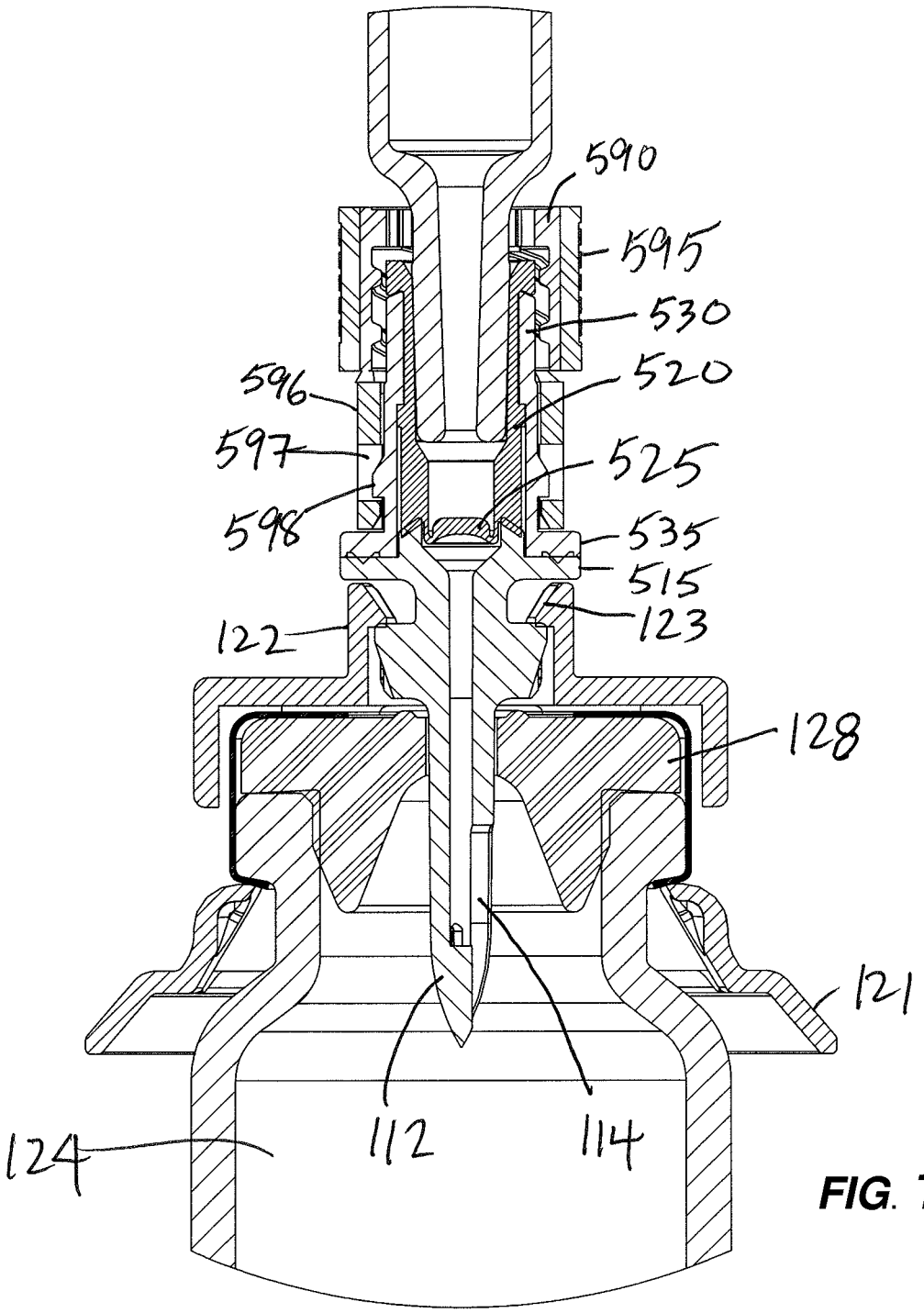
FIG. 10F is a partial sectional view along section line 10D-10D of the adapter of FIG. 10C shown in a second state of operation.

FIGS. 8A, 8B, 8C, 8D, 8E, and 8F depict another embodiment of the present disclosure. Thus adapter 400, is shown assembled to prefilled syringe device, exemplary shown without cartridge 50. As shown in FIG. 8C, adapter 400 includes Luer seal 201, preferably made of an elastomeric material similar to or identical to that used in the prefilled syringe and/or cartridge, i.e. butyl rubber, so as to minimize contact of prefilled syringe contents with other materials. Luer seal 201 provides resistance fitting of coupling member 411 with Luer adapter 109 of prefilled syringe barrel 101. All other structural elements of adapter 400 being the same as previously disclosed and described. Section view FIG. 8F shows the details of prefilled syringe barrel 101 with the luer lock collar 109 and the captured luer seal 201 within inner cylindrical wall of coupling member 211 and Luer 102 of syringe barrel.

Figure 3:
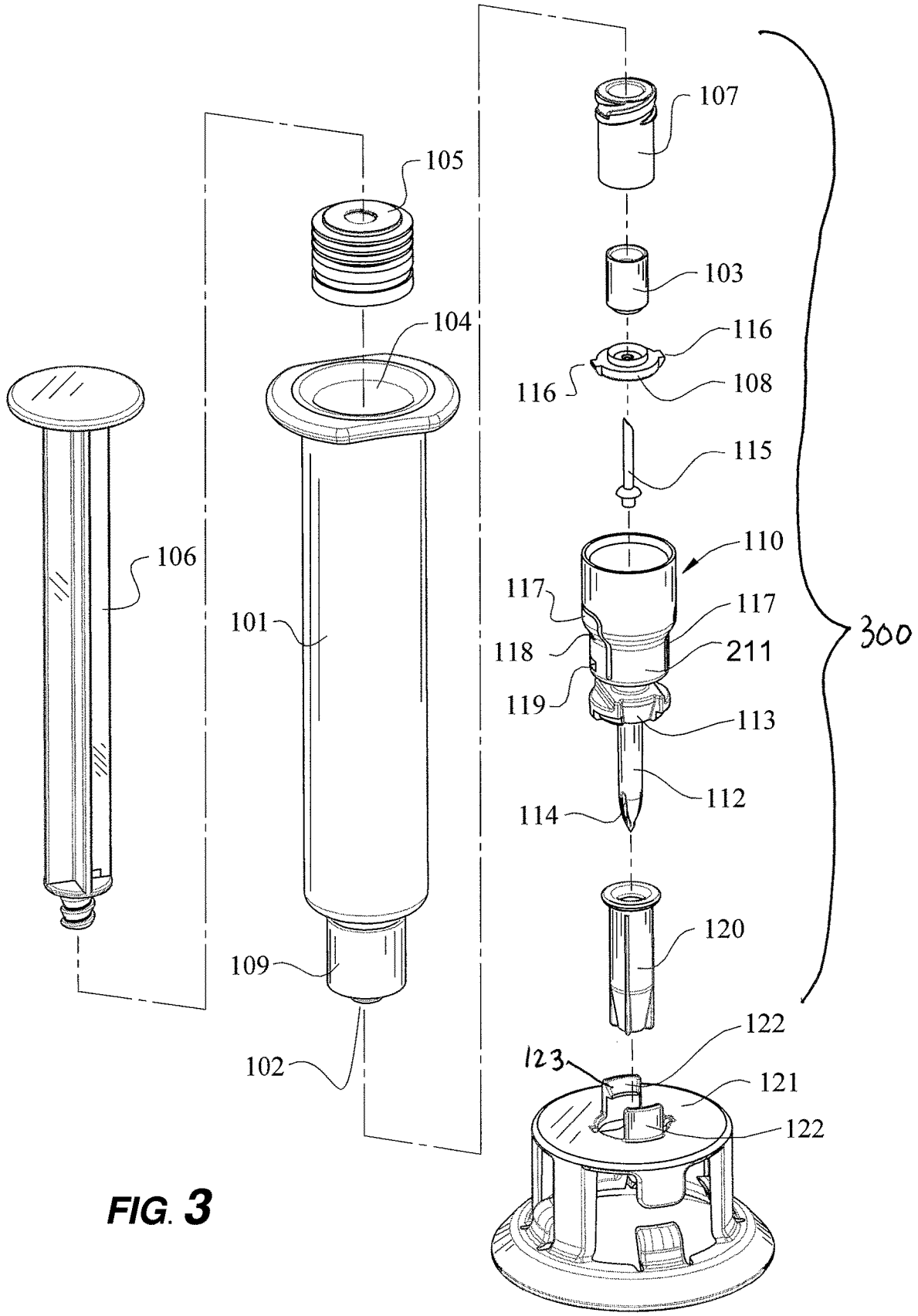
FIG. 3 is an exploded view of another adapter embodiment disclosed and described herein.

FIGS. 9A, 9B, 9C, 9D, 9E, depict an alternate embodiment of an adapter 305, which is a modification of the adapter 300 depicted in FIG. 3, with the addition of a vent port 302. Fluidically coupled to vent port 302 is modified spike 304 with conduit 114 and additional vent lumen 301. Optional vent filter media 303 can be employed.

Valve-Containing Adapter Embodiment

FIGS. 10A, 10B, 10C, 10D, 10E, and 10F, depict an alternate embodiment of an adapter 500 comprising valve 520. Valve 520 comprises a cracking pressure configured to control fluid flow between prefilled syringe device and vial 124. Cracking pressures of between about 5 psi and about 30 psi can be used depending on syringe barrel diameters as well as end-user preferences. As shown in FIGS. 10A-10F, a particular syringe barrel configuration having Luer lock collar 590 assembled to tapered syringe barrel Luer 580, which is received by Luer adapter 595 having detachable portion 596 with openings 597 adapted to receive tab members 598 of adapter 500. Adapter upper body 530 has mating surface 535 adapted to receive complementary mating surface 515 of central portion 513 for bonding, for example by ultrasonic welding or adhesive. Seat 517 of central portion 513 receives valve 525. Extending annular portion 521 of valve 520 is held on surface 533. Upon bonding of adapter upper body 530 and central portion 513, valve 520 is secured in place. Tab members 598 of adapter upper body 530 are configured to be received and held in place by openings 597 of detachable portion 596 of Luer adapter 595.

Figure 11A:
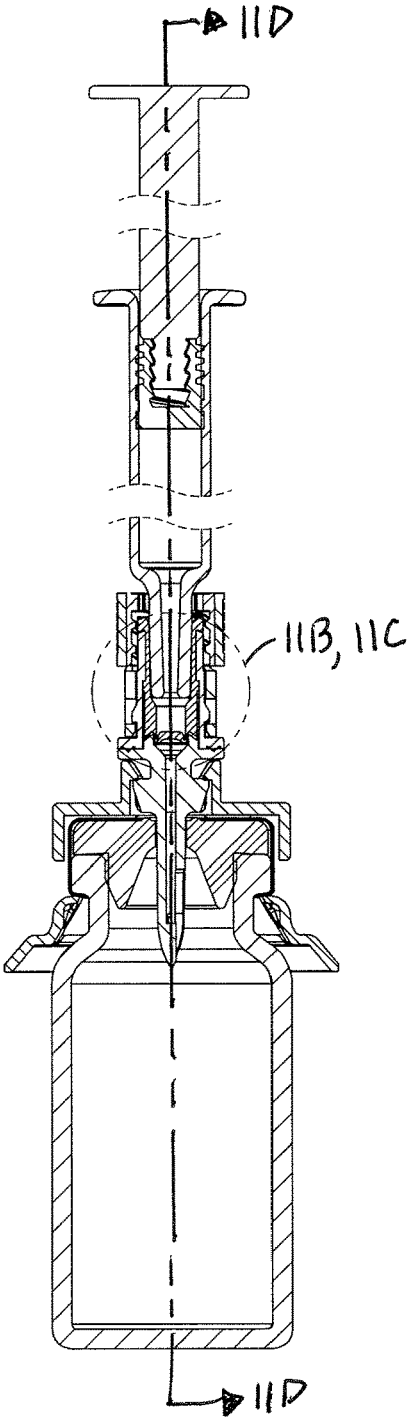
FIG. 11A is a perspective view of another adapter embodiment as disclosed and described herein.
Figure 11B:
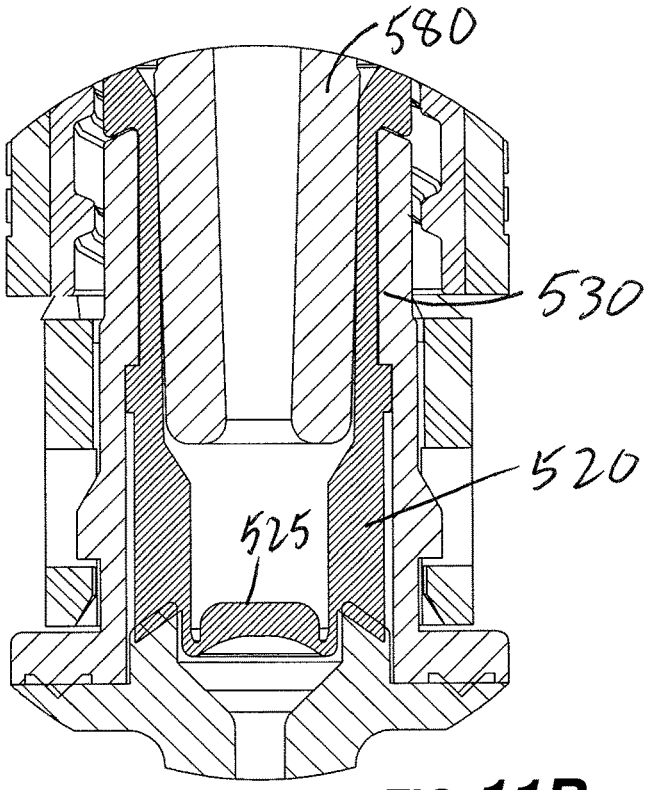
FIG. 11B is a partial sectional view of section 11B of the adapter of FIG. 11A shown in a first state.
Figure 11C:
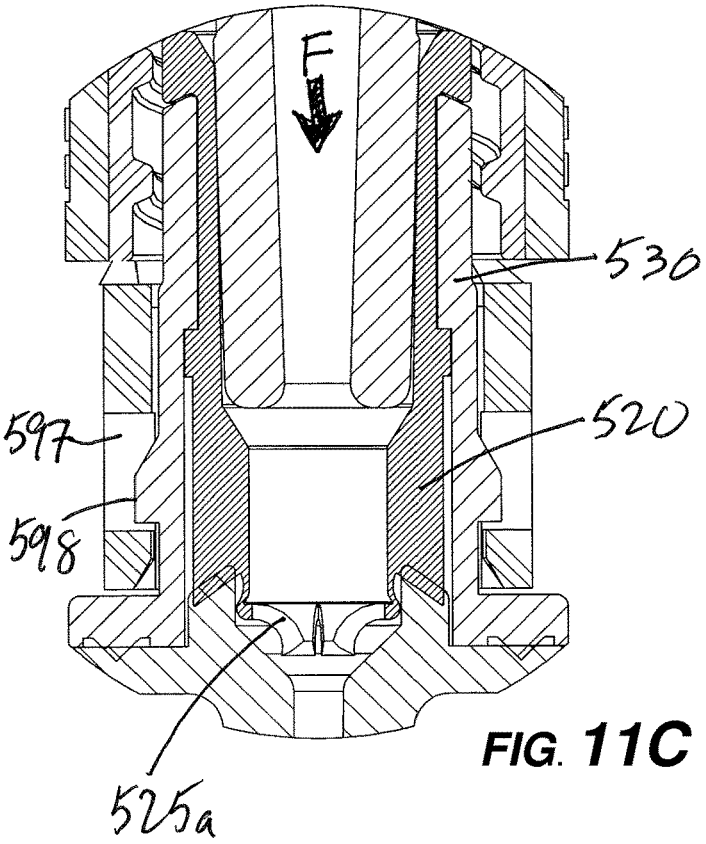
FIG. 11C is a partial sectional view of section 11C of the adapter of FIG. 11A shown in a second state of operation.
Figure 12A:
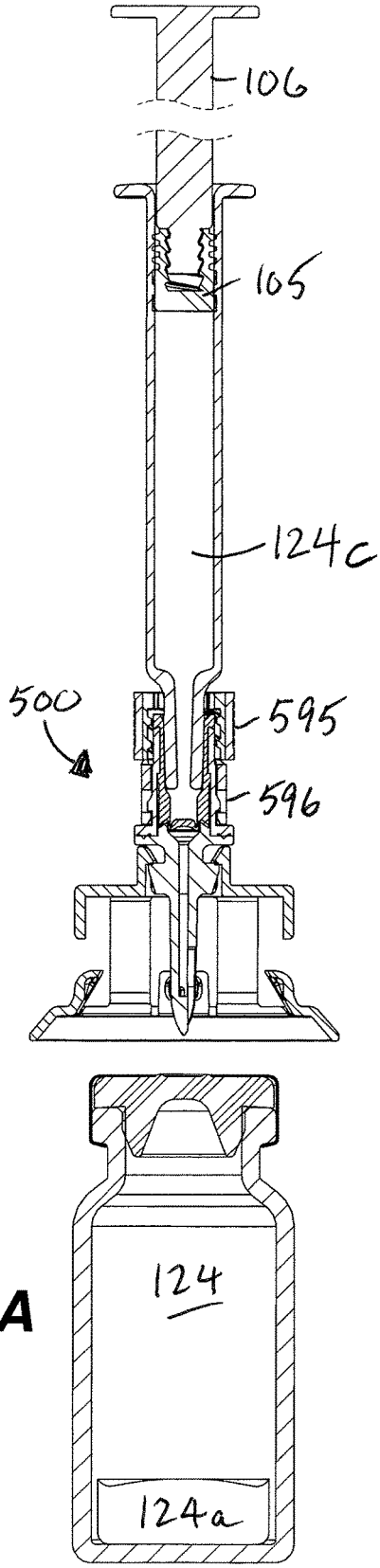
FIG. 12A is a perspective view of the adapter of FIG. 11A prior to assembly to a vial of reconstitutable medicament.
Figure 12B:
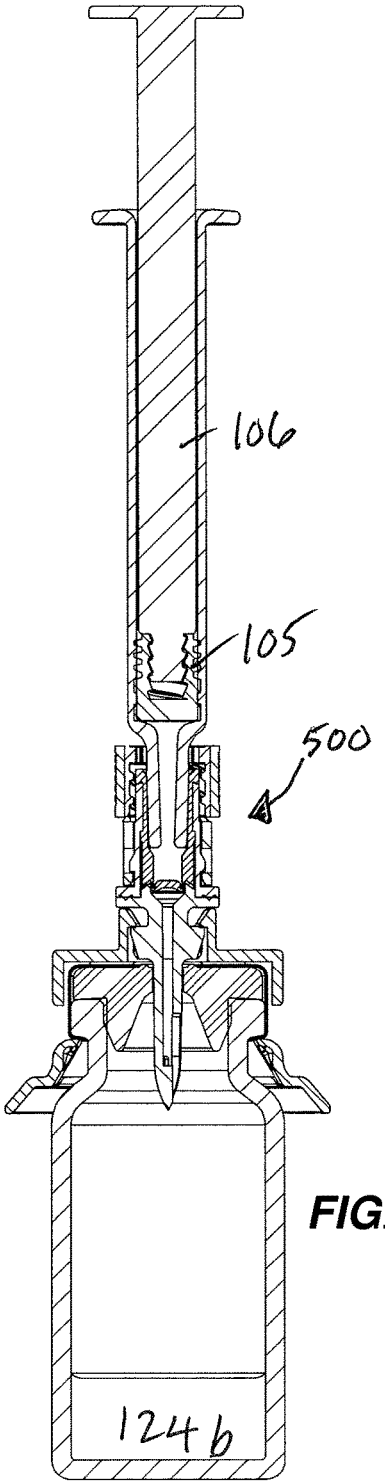
FIG. 12B is a perspective view of the adapter of FIG. 11A after assembly to a vial and after reconstitution medicament.
Figure 12C:
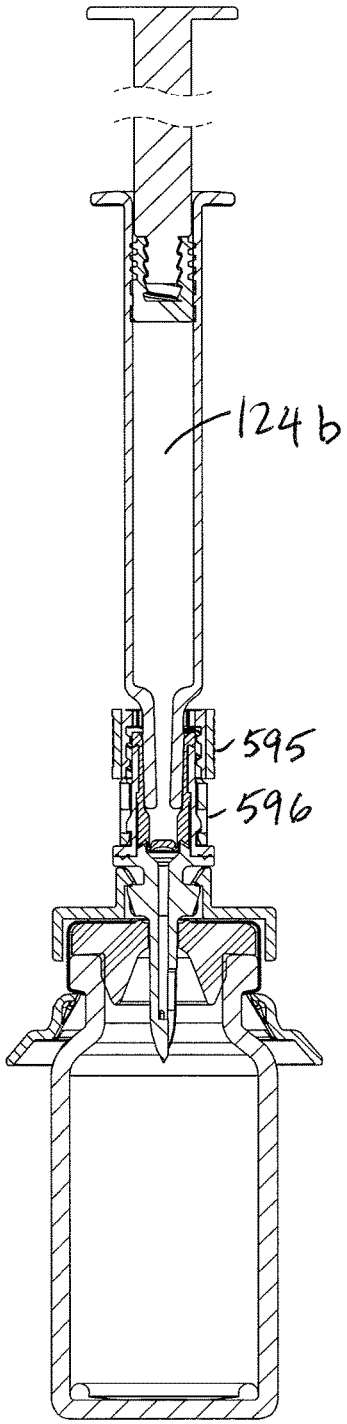
FIG. 12C is a perspective view of the adapter of FIG. 11A after assembly to a vial and after reconstitution medicament is returned to prefilled syringe.
Figure 12D:
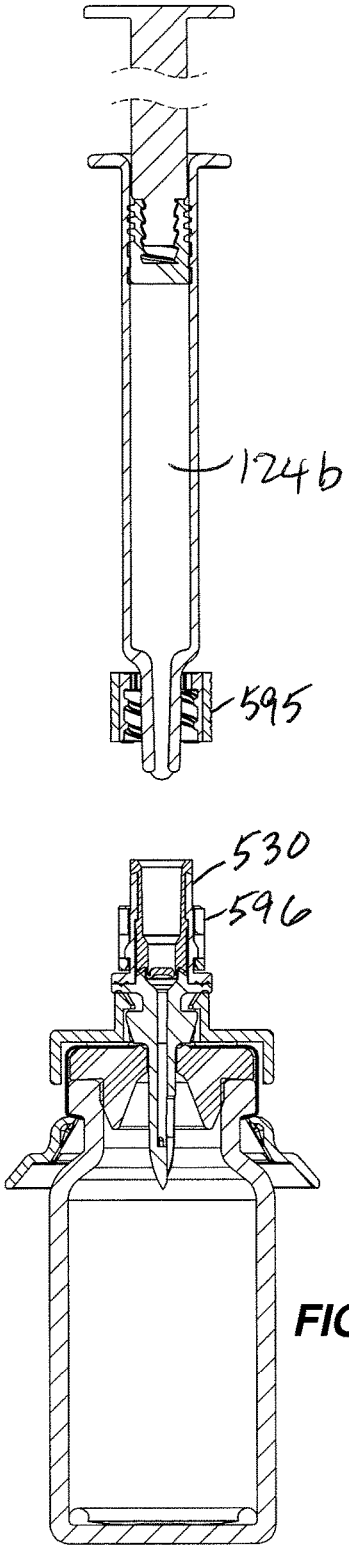
FIG. 12D is an exploded view of the adapter of FIG. 11A after reconstitution medicament is returned to prefilled syringe and after disassembly from the vial.
Figure 13:
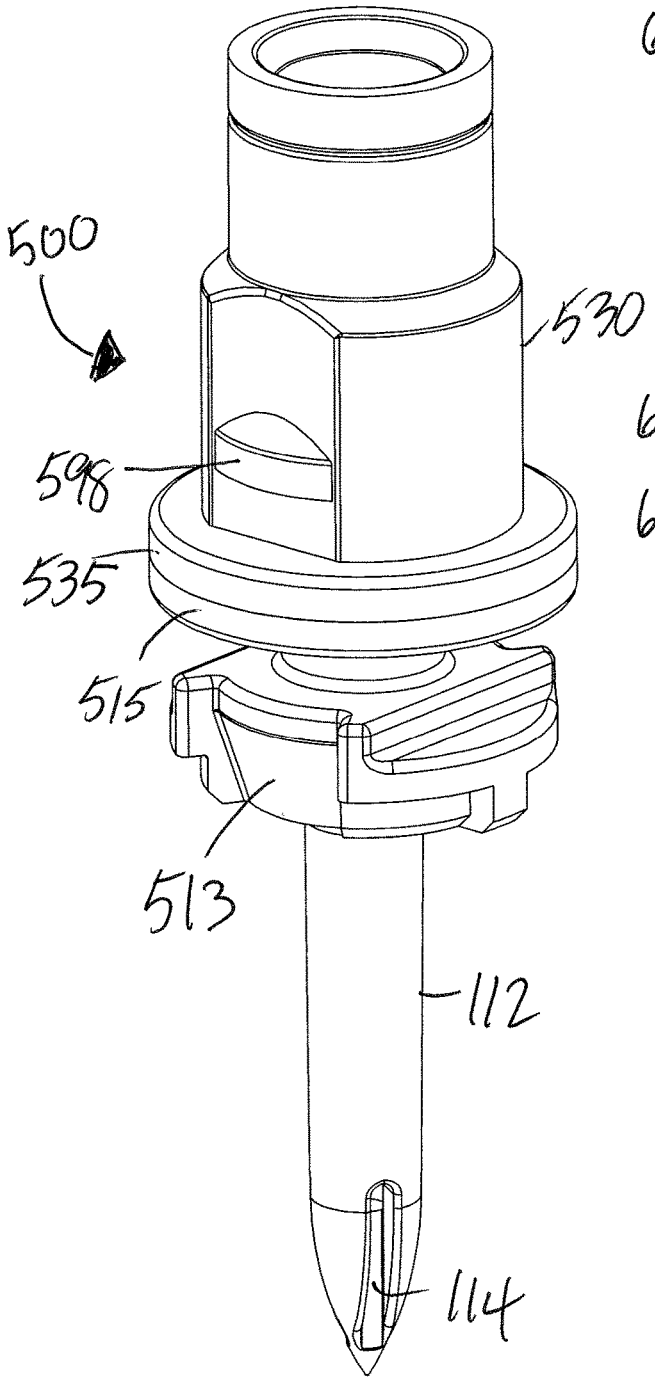
FIG. 13 is a perspective view of the adapter of FIG. 10A.
Figure 14:
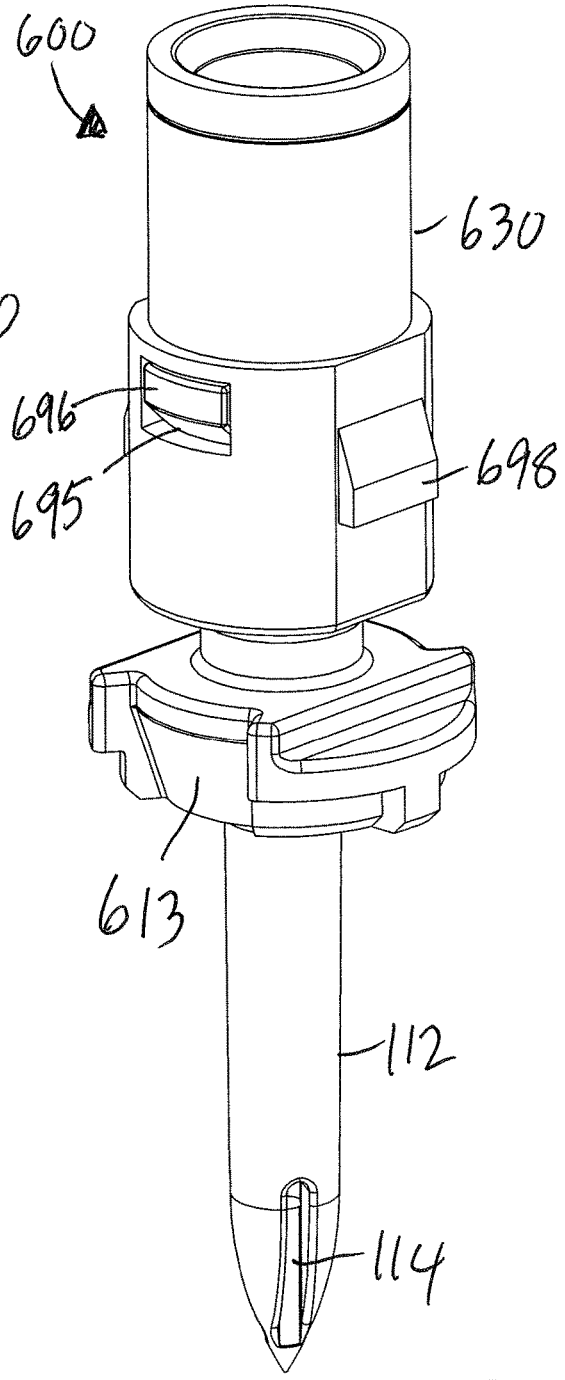
FIG. 14 is a perspective view of another adapter embodiment disclosed and described herein.
Figure 15:
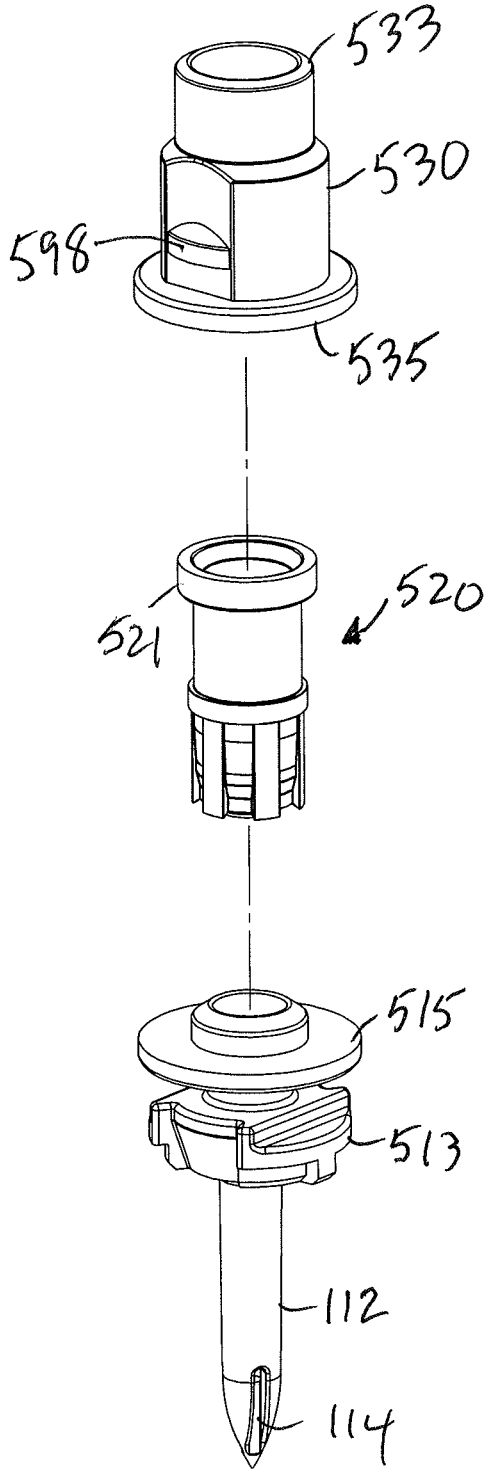
FIG. 15 is an exploded view of the adapter of FIG. 10A.
Figure 16:
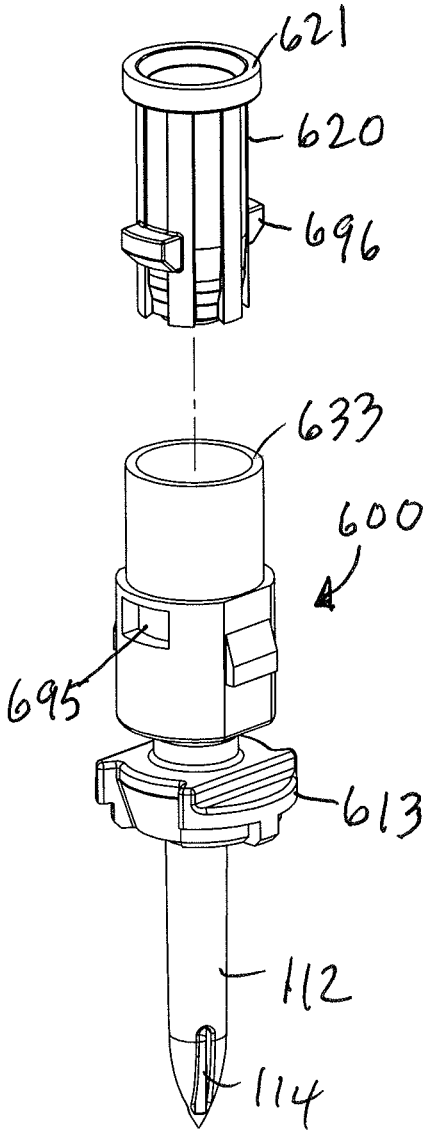
FIG. 16 is an exploded view of the adapter of FIG. 14.
Figure 17A:
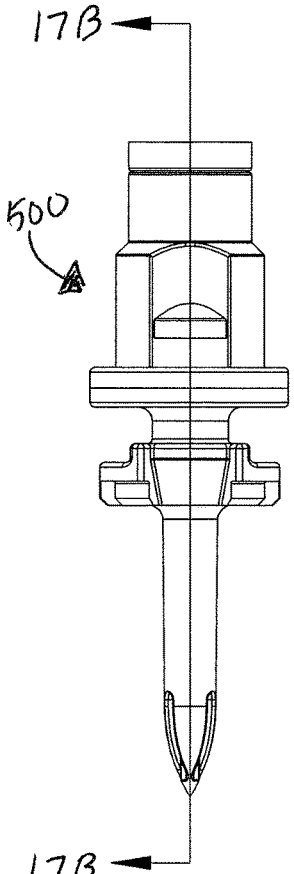
FIG. 17A is a perspective view of the adapter of FIG. 10A.
Figure 18A:
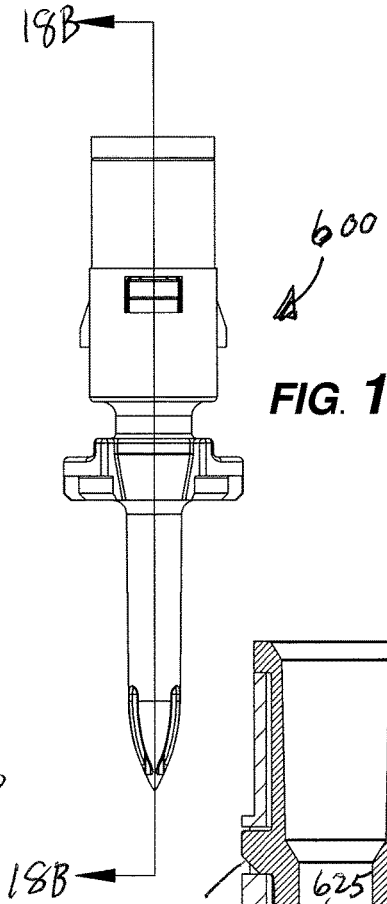
FIG. 18A is a perspective view of the adapter FIG. 14.
Figure 17B:
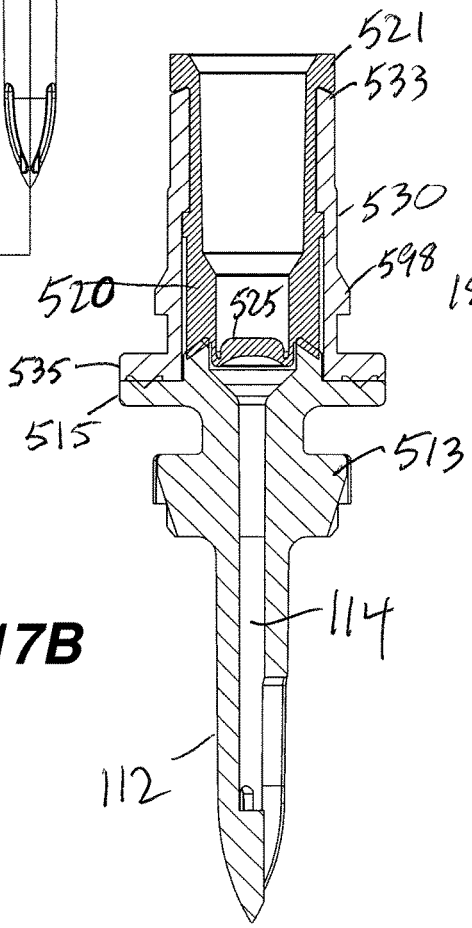
FIG. 17B is a sectional view along section line 17B-17B of the adapter of FIG. 10A.
Figure 18B:
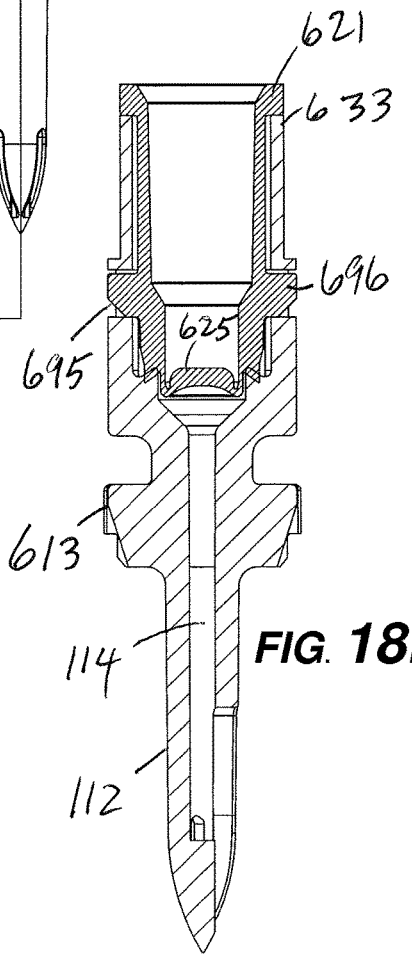
FIG. 18B is a sectional view along section line 18B-18B of the adapter of FIG. 14.

In use, adapter 500 provides for valve 520 to open at flap 525 when cracking pressure is exceeded. This will happen when contents of prefilled syringe device are urged by pushing plunger rod 106. Likewise, cracking pressure will be exceeded and flap 525 will open when the contents of vial 124 and diluent of prefilled syringe device are withdrawn by reversing the direction of plunger rod 106, as shown in FIGS. 11A, 11B, and 11C.

FIGS. 13, 14, 15, 16, and 17A, 17B, 18A and 18B, show modifications of the valve-containing adapter assembly and alternative methods of manufacturing. Thus, adapter 500 being previously described as having complementary mating surfaces 515, 535 suitable for ultrasonic welding or adhesive or solvent bonding presents one alternative manufacturing process as shown in FIGS. 13, 15 and 17A, 17B.

Adapter 600 of FIGS. 14, 16, and 18A and 18B is shown with upper adapter body 630 coupled to central portion 613 having openings 695 in its generally cylindrical sidewall configured to receive extending tabs 696 of valve 620. Annular flange 621 of valve 620 sits on rim 633 of upper adapter body 630 to secure the valve in the adapter body.

Modifications and Alternatives to the previously disclosed embodiments include, for example, alternate attachment and access means, among other things. The embodiments described herein may alternately be equipped with other attachment means in place of the described vial shroud, for example, for securing to various containers as well as being equipped with other access means in place of the septum spike to connect to various containers, such as but not limited to diluent bags, non-standard vials, or cartridges.

The attachment of adapter 500 with shroud 121 to vial 124 containing reconstitutable medicament 124*a* and the sequence of introducing diluent and the withdrawal of reconstituted medicament 124*b*, and the disconnection of reconstituted medicament contained in prefilled syringe device by the separation of Luer adapter 595 from detachable portion 596 is shown via sectional views of FIGS. 12A, 12B, 12C, and 12D.

In some embodiments, applicable to all of the adapter embodiments disclosed and described herein, to reconstitute a lyophilized drug or otherwise add fluid to a liquid or powdered drug, the spike cover coupled to the prefilled device comprising the present adapter embodiment is removed and the adapter is coupled (snapped on) to the accessible, penetrable top of the drug vial. During this attachment, in some embodiments, an internal cannula of the prefilled device penetrates an elastomeric plug, completing the fluid path between the prefilled device and the vial.

The present adapter is configured for a low-force, permanent attachment to the prefilled device and/or drug vial. A user can then depresses the plunger to inject the diluent into the vial. The assembly can then be swirled normally to reconstitute the drug, with the vial adapter holding the syringe securely in place. When the drug is dissolved, mixed, or in suspension, the assembly can be inverted and the drug withdrawn into the syringe. A slot in the adapter spike allows the drug to be removed fully. The syringe can then be detached from the adapter at the luer lock connection, ready to be fitted with the appropriate needle, IV connector, etc., or similar device for injection.

The invention claimed is:

1. An adapter comprising:

an adapter body, the adapter body having generally cylindrical side walls extending longitudinally from a central body, the adapter body comprising:

longitudinally separated openings in the cylindrical side walls;

a coupling member configured for coupling with a prefillable assembly, wherein the coupling member is generally cylindrical with outwardly extending tabs configured for engagement with the longitudinally separated openings within the cylindrical side walls of the adapter body; and a spike extending from the central body;

at least one conduit extending through the spike, adapter body and the coupling member;

a spike cover sized to receive and seal the spike, the cover reversibly attached to the central body;

an elastomeric plug positioned within the coupling member, the elastomeric plug secured between the coupling member and the central body; and a penetrating cannula having one end coupled to the central body, the penetrating cannula fluidically coupled to the at least one conduit and a second end extending at least partially into the coupling member.

2. An adapter comprising:

an adapter body, the adapter body having generally cylindrical side walls extending longitudinally from a central body, the adapter body comprising:

first openings in the cylindrical side walls, and second openings longitudinally positioned from the first openings;

a coupling member configured for coupling with a pre-fillable assembly, wherein the coupling member is generally cylindrical and comprises outwardly extending tabs received by the first openings or the second openings within the cylindrical side walls of the adapter body; and a spike extending from the central body opposite that of the coupling member;

at least one conduit extending through the spike, adapter body and the coupling member;

a spike cover sized to receive and seal the spike, the cover reversibly attached to the central body;

an elastomeric plug positioned within the coupling member, the elastomeric plug secured between the coupling member and the central body; and a penetrating cannula having one end coupled to the central body, the penetrating cannula fluidically coupled to the at least one conduit and a second end extending at least partially into the coupling member;

wherein the adapter transitions from a first state wherein the extending tabs of the coupling member are engaged with the first openings of the adapter body and the second end of the penetrating cannula is sealed by the elastomeric plug, to a second state wherein the extending tabs of the coupling member are engaged with the second openings of the adapter body and the second end of the penetrating cannula penetrates the elastomeric plug providing fluidic communication between the coupling member and the at least one conduit of the spike in the second state;

wherein the adapter transitions from the first state to the second state upon coupling of the coupling member with a pre-fillable device.

* * * * *